US009240194B2

(12) United States Patent
Kamai et al.

(10) Patent No.: US 9,240,194 B2
(45) Date of Patent: Jan. 19, 2016

(54) VOICE QUALITY CONVERSION SYSTEM, VOICE QUALITY CONVERSION DEVICE, VOICE QUALITY CONVERSION METHOD, VOCAL TRACT INFORMATION GENERATION DEVICE, AND VOCAL TRACT INFORMATION GENERATION METHOD

(71) Applicant: Panasonic Corporation, Osaka (JP)

(72) Inventors: Takahiro Kamai, Kyoto (JP); Yoshifumi Hirose, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 283 days.

(21) Appl. No.: 13/872,183

(22) Filed: Apr. 29, 2013

(65) Prior Publication Data

US 2013/0238337 A1 Sep. 12, 2013

Related U.S. Application Data

(63) Continuation of application No. PCT/JP2012/004517, filed on Jul. 12, 2012.

(30) Foreign Application Priority Data

Jul. 14, 2011 (JP) ..... 2011-156042

(51) Int. Cl.
*G10L 13/00* (2006.01)
*G10L 21/003* (2013.01)
(Continued)

(52) U.S. Cl.
CPC ..... *G10L 21/003* (2013.01); *G10L 25/15* (2013.01); *G10L 13/033* (2013.01); *G10L 21/04* (2013.01)

(58) Field of Classification Search
CPC ..... G10L 13/00; G10L 13/02; G10L 13/027; G10L 13/033; G10L 13/043; G10L 13/10
USPC ..... 704/258, 260, 261, 266, 269, 278
See application file for complete search history.

(56) References Cited

U.S. PATENT DOCUMENTS 4,624,012 A * 11/1986 Lin et al. ..... 704/261
8,155,964 B2 4/2012 Hirose et al.

(Continued)

FOREIGN PATENT DOCUMENTS

JP 07-072900 3/1995
JP 2001-282300 10/2001

(Continued)

OTHER PUBLICATIONS

International Search Report issued Oct. 9, 2012 in International (PCT) Application No. PCT/JP2012/004517.

*Primary Examiner* — Qi Han
(74) *Attorney, Agent, or Firm* — Wenderoth, Lind & Ponack, L.L.P.

(57) ABSTRACT

A voice quality conversion system includes: an analysis unit which analyzes sounds of plural vowels of different types to generate first vocal tract shape information for each type of the vowels; a combination unit which combines, for each type of the vowels, the first vocal tract shape information on that type of vowel and the first vocal tract shape information on a different type of vowel to generate second vocal tract shape information on that type of vowel; and a synthesis unit which (i) combines vocal tract shape information on a vowel included in input speech and the second vocal tract shape information on the same type of vowel to convert vocal tract shape information on the input speech, and (ii) generates a synthetic sound using the converted vocal tract shape information and voicing source information on the input speech to convert the voice quality of the input speech.

15 Claims, 27 Drawing Sheets

(51) Int. Cl.

| | |
|---|---|
| ***G10L 25/15*** | (2013.01) |
| *G10L 21/04* | (2013.01) |
| *G10L 13/033* | (2013.01) |

(56) References Cited

U.S. PATENT DOCUMENTS

| | | | | |
|---|---|---|---|---|
| 8,370,153 | B2 | 2/2013 | Hirose et al. | |
| 2006/0129399 | A1* | 6/2006 | Turk et al. | 704/256 |
| 2007/0027687 | A1* | 2/2007 | Turk et al. | 704/246 |
| 2009/0281807 | A1 | 11/2009 | Hirose et al. | |
| 2010/0004934 | A1* | 1/2010 | Hirose et al. | 704/261 |
| 2010/0204990 | A1 | 8/2010 | Hirose et al. | |
| 2010/0250257 | A1 | 9/2010 | Hirose et al. | |

FOREIGN PATENT DOCUMENTS

| | | |
|---|---|---|
| JP | 2006-330343 | 12/2006 |
| JP | 2007-050143 | 3/2007 |
| WO | 2008/142836 | 11/2008 |
| WO | 2008/149547 | 12/2008 |
| WO | 2010/035438 | 4/2010 |

* cited by examiner

FIG. 6

| | Root mean square error (RMSE) |
|---|---|
| F1-F2 average of in-sentence vowels | 399.5 |
| F1-F2 average of discrete vowels | 422.5 |
| Average vocal tract shape information on discrete vowels | 404.0 |

"/ne e go i N kyo sa N, mu ka shi ka ra, tsu ru wa se N ne N, ka me wa ma N ne N na N te ko to o i i ma su ne/" ( "Hi daddy. They say crane lives longer than a thousand years, and tortoise lives longer than ten thousand years, don't they?" )

(a)

(b)

VOICE QUALITY CONVERSION SYSTEM, VOICE QUALITY CONVERSION DEVICE, VOICE QUALITY CONVERSION METHOD, VOCAL TRACT INFORMATION GENERATION DEVICE, AND VOCAL TRACT INFORMATION GENERATION METHOD

CROSS REFERENCE TO RELATED APPLICATIONS

This is a continuation application of PCT International Application No. PCT/JP2012/004517 filed on Jul. 12, 2012, designating the United States of America, which is based on and claims priority of Japanese Patent Application No. 2011-156042 filed on Jul. 14, 2011. The entire disclosures of the above-identified applications, including the specifications, drawings and claims are incorporated herein by reference in their entirety.

FIELD

One or more exemplary embodiments disclosed herein relate generally to voice quality conversion techniques.

BACKGROUND

An example of conventional voice quality conversion techniques is to prepare a large number of pairs of speech of the same content spoken in two different ways (e.g., emotions) and learn conversion rules between the two different ways of speaking from the prepared pairs of speech (see Patent Literature (PTL) 1, for example). The voice quality conversion technique according to PTL 1 allows conversion of speech without emotion into speech with emotion based on a learning model.

The voice quality conversion technique according to PTL 2 extracts a feature value from a small number of discretely uttered vowels to perform conversion into target speech.

CITATION LIST

Patent Literature

[PTL 1] Japanese Unexamined Patent Application Publication No. 7-72900

[PTL 2] International Patent Application Publication No. 2008/142836

SUMMARY

Technical Problem

However, the above voice quality conversion techniques sometimes fail to convert input speech into smooth and natural speech.

In view of this, one non-limiting and exemplary embodiment provides a voice quality conversion system which can convert input speech into smooth and natural speech.

Solution to Problem

A voice quality conversion system according to an exemplary embodiment disclosed herein is a voice quality conversion system which converts a voice quality of input speech using vocal tract shape information indicating a shape of a vocal tract, the system including: a vowel receiving unit configured to receive sounds of plural vowels of different types;

an analysis unit configured to analyze the sounds of the plural vowels received by the vowel receiving unit to generate first vocal tract shape information for each type of the vowels; a combination unit configured to combine, for each type of the vowels, the first vocal tract shape information on the type of vowel and the first vocal tract shape information on a different type of vowel to generate second vocal tract shape information on the type of vowel; and a synthesis unit configured to (i) obtain vocal tract shape information and voicing source information on the input speech, (ii) combine vocal tract shape information on a vowel included in the input speech and the second vocal tract shape information on a same type of vowel as the vowel included in the input speech to convert the vocal tract shape information on the input speech, and (iii) generate a synthetic sound using the vocal tract shape information on the input speech resulting from the conversion and the voicing source information on the input speech to convert the voice quality of the input speech.

This general aspect may be implemented using a system, a method, an integrated circuit, a computer program, or a computer-readable recording medium such as a Compact Disc Read Only Memory (CD-ROM), or any combination of systems, methods, integrated circuits, computer programs, or recording media.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

The voice quality conversion system according to one or more exemplary embodiments or features disclosed herein can convert input speech into smooth and natural speech.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 1 is a schematic diagram showing an example of a vowel spectral envelope.

FIG. 2A shows distribution of the first and second formant frequencies of discrete vowels.

FIG. 2B shows distribution of the first and second formant frequencies of in-sentence vowels.

FIG. 3 shows an acoustic tube model of a human vocal tract.

FIG. 4A shows a relationship between discrete vowels and average vocal tract shape information.

FIG. 4B shows a relationship between in-sentence vowels and average vocal tract shape information.

FIG. 5A shows the average of the first and second formant frequencies of discrete vowels.

FIG. 5B shows the average of the first and second formant frequencies of in-sentence vowels.

[FIG. 6]

FIG. 6 shows the root mean square error between (i) each of the F1-F2 average of in-sentence vowels, the F1-F2 average of discrete vowels, and average vocal tract shape information and (ii) the first and second formant frequencies of plural in-sentence vowels.

FIG. 7 illustrates the effect of moving the position of each discrete vowel on the F1-F2 plane toward the position of average vocal tract shape information.

FIG. 8 is a configuration diagram of a voice quality conversion system according to Embodiment 1.

FIG. 9 shows an example of a detailed configuration of an analysis unit according to Embodiment 1.

FIG. 10 shows an example of a detailed configuration of a synthesis unit according to Embodiment 1.

FIG. 11A is a flowchart showing operations of a voice quality conversion system according to Embodiment 1.

FIG. 11B is a flowchart showing operations of a voice quality conversion system according to Embodiment 1.

FIG. 12 is a flowchart showing operations of a voice quality conversion system according to Embodiment 1.

FIG. 13A shows the result of an experiment in which the voice quality of Japanese input speech is converted.

FIG. 13B shows the result of an experiment in which the voice quality of English input speech is converted.

FIG. 14 shows the 13 English vowels placed on the F1-F2 plane.

FIG. 15 shows an example of a vowel receiving unit according to Embodiment 1.

FIG. 16 shows polygons formed on the F1-F2 plane when the first and second formant frequencies of all discrete vowels are moved at a ratio q.

FIG. 17 illustrates a conversion method for increasing or decreasing a vocal tract cross-sectional area function at a vocal tract length conversion ratio r.

FIG. 18 illustrates a conversion method for increasing or decreasing a vocal tract cross-sectional area function at a vocal tract length conversion ratio r.

FIG. 19 illustrates a conversion method for increasing or decreasing a vocal tract cross-sectional area function at a vocal tract length conversion ratio r.

FIG. 20 is a configuration diagram of a voice quality conversion system according to Embodiment 2.

FIG. 21 illustrates a sound of each vowel outputted by a vocal tract information generation device according to Embodiment 2.

FIG. 22 is a configuration diagram of a voice quality conversion system according to Embodiment 3.

FIG. 23 is a configuration diagram of a voice quality conversion system according to another embodiment.

FIG. 24 is a configuration diagram of a voice quality conversion device according to PTL 1.

FIG. 25 is a configuration diagram of a voice quality conversion device according to PTL 2.

DESCRIPTION OF EMBODIMENTS

Figure 1:
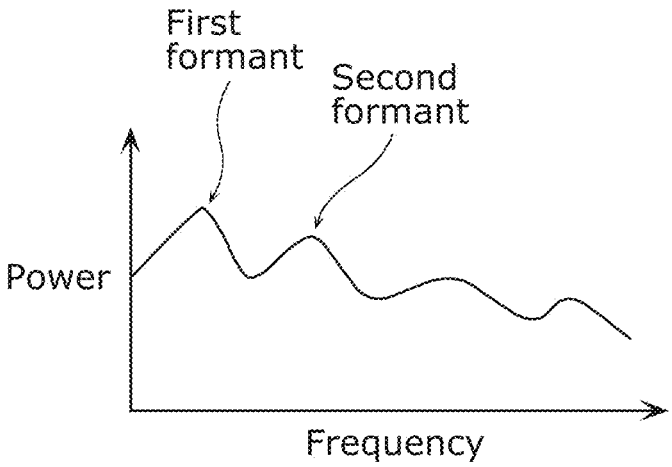
[FIG. 1]

Underlying Knowledge Forming Basis of the Present Disclosure

The speech output function of devices and interfaces plays an important role in, for example, informing the user of the operation method and the state of the device. Furthermore, information devices utilize the speech output function as a function to read out, for example, text information obtained via a network.

Recently, devices have become personified and thus have increasingly been required to output a characteristic voice. For example, since people perceive humanoid robots as having a character, people are likely to feel uncomfortable if the humanoid robots talk in a monotonous synthetic voice.

Furthermore, there are services that allow a word of a user's choice to be spoken in a celebrity's or cartoon character's voice. What lies at the center of demand for the applications that provide such services is characteristic voices rather than the content of the speech.

As described above, what is required of the speech output function is extending from clarity or accuracy, which used to be the main requirement in the past, to choices of types of voice or conversion into a voice of the user's choice.

As means to implement such a speech output function, there are a recoding and playing back method for recording and playing back a person's speech and a speech synthesizing method for generating a speech waveform from text or a pronunciation symbol. The recoding and playing back method has an advantage of fine sound quality and disadvantages of increase in the memory capacity and inability to change the content of speech depending on the situation.

In contrast, the speech synthesizing method can avoid an increase in the memory capacity because the content of speech can be changed depending on text, but is inferior to the recoding and playing back method in terms of the sound quality and the naturalness of intonation. Thus, it is often the case that the recoding and playing back method is selected when there are few types of messages, whereas the speech synthesizing method is selected when there are many types of messages.

However, with either method, the types of voice are limited to the types of voice prepared in advance. That is to say, when use of two types of voice, such as a male voice and a female voice, is desired, it is necessary to record both voices in advance or prepare speech synthesis units for both voices, with the result that the cost for the device and development increases. Moreover, it is impossible to modulate or change the input voice to a voice of a user's choice.

In view of this, there is an increasing demand for a voice quality conversion technique for altering the features of a subject speaker's voice to approximate the features of another speaker's voice.

As described earlier, an example of the conventional voice quality conversion techniques is to prepare a large number of pairs of speech of the same content spoken in two different ways (e.g., different emotions) and learn conversion rules between the two different ways of speaking from the prepared pairs of speech (see PTL 1, for example).

Figure 24:
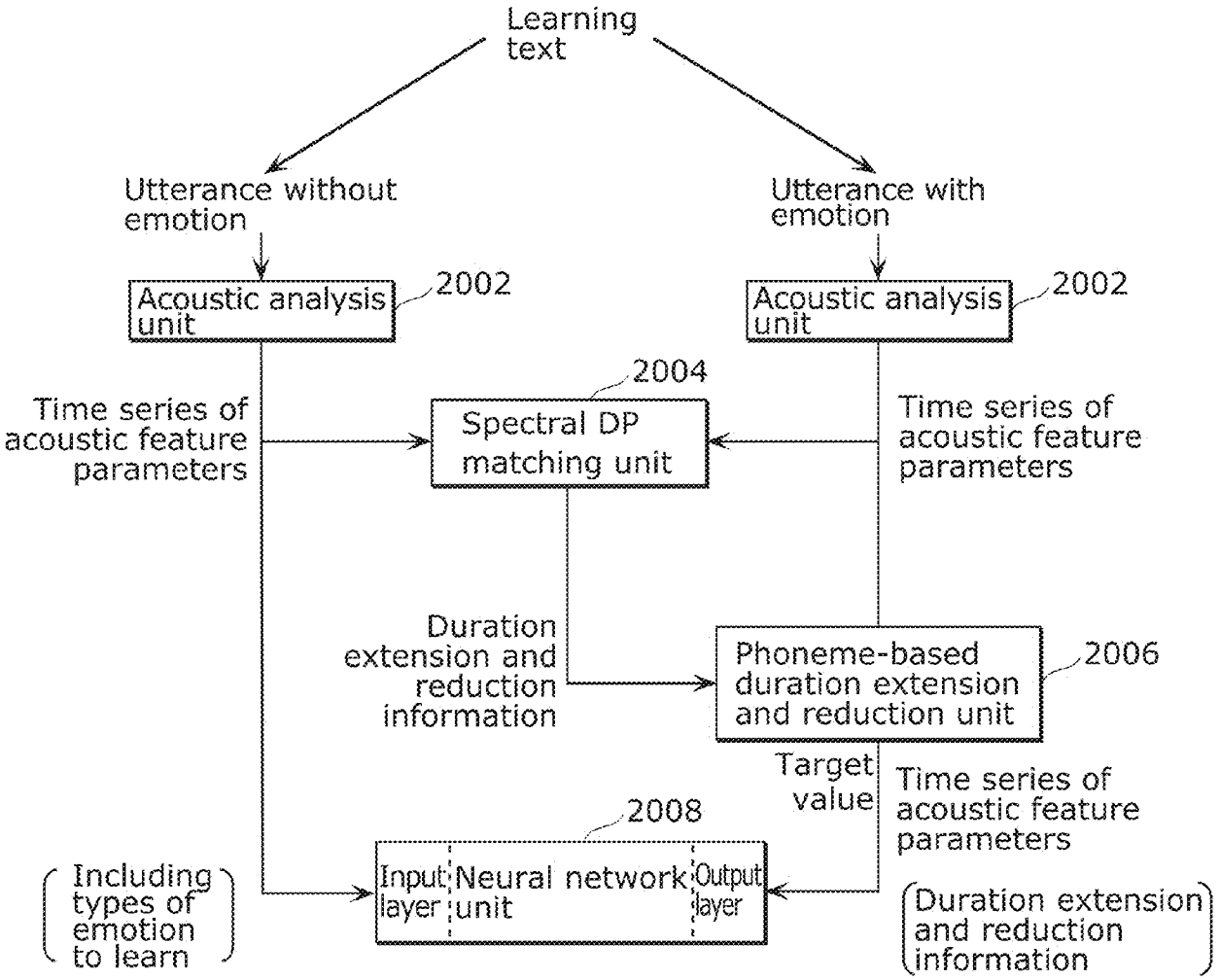
[FIG. 24]

FIG. 24 is a configuration diagram of a voice quality conversion device according to PTL 1.

The voice quality conversion device shown in FIG. 24 includes acoustic analysis units 2002, a spectral dynamic programming (DP) matching unit 2004, a phoneme-based duration extension and reduction unit 2006, and a neural network unit 2008.

The neural network unit 2008 learns to convert acoustic characteristic parameters of a speech without emotion to acoustic characteristic parameters of a speech with emotion. After that, an emotion is added to the speech without emotion using the neural network unit 2008 which has performed the learning.

For spectral characteristic parameters among characteristic parameters extracted by the acoustic analysis units 2002, the spectral DP matching unit 2004 examines, from moment to moment, the similarity between the speech without emotion and the speech with emotion. The spectral DP matching unit 2004 then makes a temporal association between identical phonemes to calculate, for each phoneme, a temporal extension and reduction rate of the speech with emotion to the speech without emotion.

The phoneme-based duration extension and reduction unit 2006 temporally normalizes the time series of the feature parameters of the speech with emotion to match with the time series of the feature parameters of the speech without emotion, according to the temporal extension and reduction rate obtained for each phoneme by the spectral DP matching unit 2004.

In the learning process, the neural network unit 2008 learns the difference between the acoustic feature parameters of the speech without emotion provided to the input layer from moment to moment and the acoustic feature parameters of the speech with emotion provided to the output layer.

When adding an emotion, the neural network unit 2008 estimates, using weighting factors in the network determined in the learning process, the acoustic feature parameters of the speech with emotion from the acoustic feature parameters of the speech without emotion provided to the input layer from moment to moment. This is the way in which the voice quality conversion device converts a speech without emotion to a speech with emotion based on the learning model.

However, the technique according to PTL 1 requires recording of speech which has the same content as that of predetermined learning text and is spoken with a target emotion. Thus, when the technique according to PTL 1 is to be used for converting the speaker, all the predetermined learning text needs to be spoken by a target speaker. This increases the load on the target speaker.

In view of this, to reduce the load on the target speaker, a technique has been proposed for extracting and using a feature value of the target speaker from a small amount of speech (see PTL 2, for example).

Figure 25:
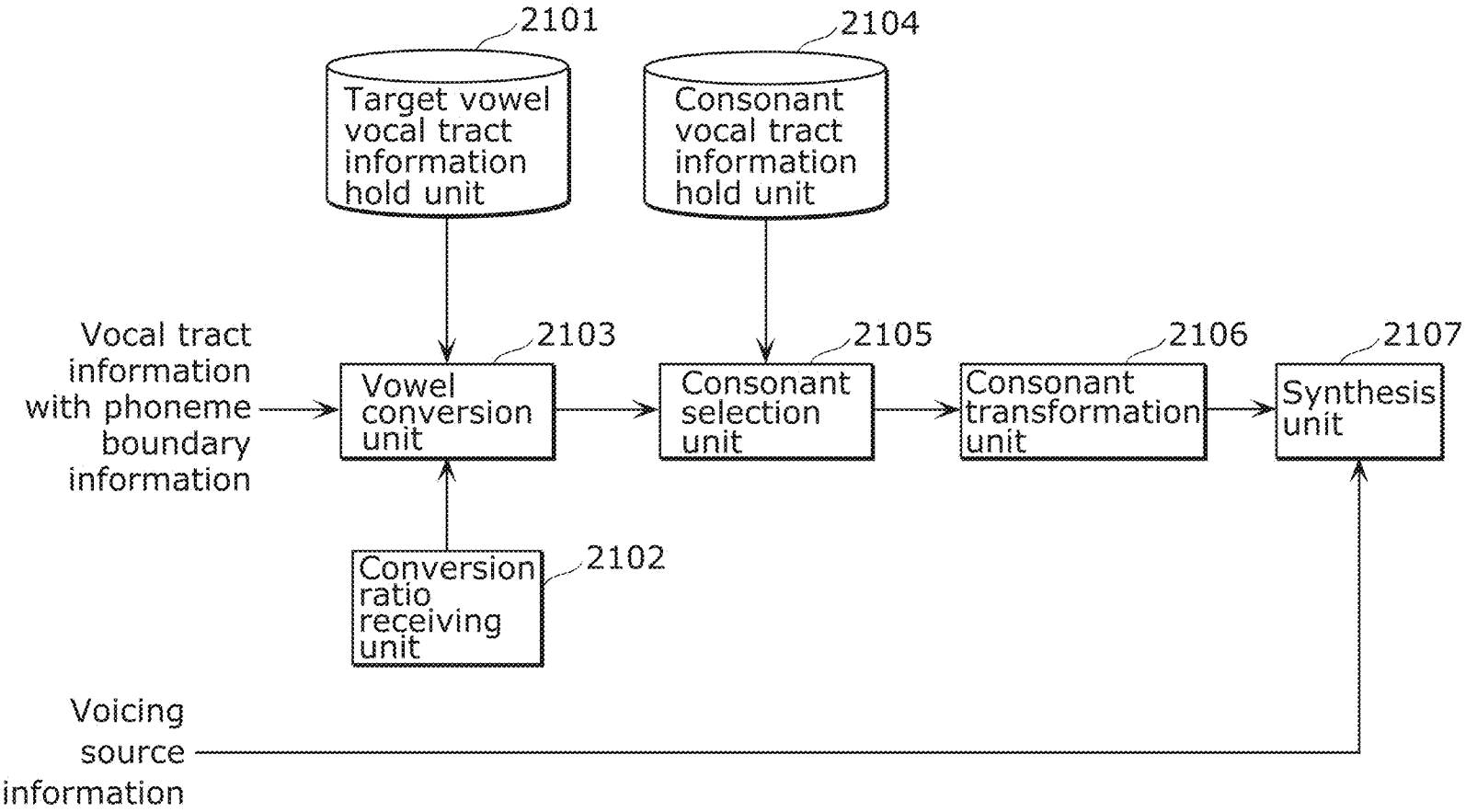
[FIG. 25]

FIG. 25 is a configuration diagram of a voice quality conversion device according to PTL 2.

The voice quality conversion device shown in FIG. 25 converts the voice quality of input speech by converting vocal tract information on a vowel included in the input speech to vocal tract information on a vowel of a target speaker at a provided conversion ratio. Here, the voice quality conversion device includes a target vowel vocal tract information hold unit 2101, a conversion ratio receiving unit 2102, a vowel conversion unit 2103, a consonant vocal tract information hold unit 2104, a consonant selection unit 2105, a consonant transformation unit 2106, and a synthesis unit 2107.

The target vowel vocal tract information hold unit 2101 holds target vowel vocal tract information extracted from representative vowels uttered by the target speaker. The vowel conversion unit 2103 converts vocal tract information on each vowel segment of the input speech using the target vowel vocal tract information.

At this time, the vowel conversion unit 2103 combines the vocal tract information on each vowel segment of the input speech with the target vowel vocal tract information based on a conversion ratio provided by the conversion ratio receiving unit 2102. The consonant selection unit 2105 selects vocal tract information on a consonant from the consonant vocal tract information hold unit 2104, with the flow from the preceding vowel and to the subsequent vowel taken into consideration. Then, the consonant transformation unit 2106 transforms the selected vocal tract information on the consonant to provide a smooth flow from the preceding vowel and to the subsequent vowel. The synthesis unit 2107 generates a synthetic speech using (i) voicing source information on the input speech and (ii) the vocal tract information converted by the vowel conversion unit 2103, the consonant selection unit 2105, and the consonant transformation unit 2106

However, since the technique according to PTL 2 uses the vocal tract information on discretely uttered vowels as the vocal tract information on the target speech, the speech resulting from the conversion is neither smooth nor natural. This is due to the fact that there is a difference between the features of discretely uttered vowels and the features of vowels included in speech continuously uttered as a sentence. Thus, application of the voice quality conversion to a speech in daily conversation, for example, significantly reduces the speech naturalness.

As described above, when the voice quality of the input speech is to be converted using a small number of samples of the target speech, the conventional voice quality conversion techniques are unable to convert the input speech to smooth and natural speech. More specifically, the technique according to PTL 1 requires a large amount of utterance by the target speaker since the conversion rules need to be learnt from a large number of pairs of speech having the same content spoken in different ways. In contrast, the technique according to PTL 2 is advantageous that the voice quality conversion only requires the input of sounds of vowels uttered by the target speaker; however, the produced speech is not so natural because the available speech feature value is that of discretely uttered vowels.

In view of such problems, the inventors of the present application have gained the knowledge described below.

Vowels included in discrete utterance speech have a feature different from that of vowels included in speech uttered as a sentence. For example, the vowel "A" when only "A" is uttered has a feature different from that of "A" at end of the Japanese word「こんにちは」"/ko N ni chi wa/". Likewise, the vowel "E" when only "E" is uttered has a feature different from that of "E" included in the English word "Hello".

Hereinafter, uttering discretely is also referred to as "discrete utterance", and uttering continuously as a sentence is also referred to as "continuous utterance" or "sentence utterance". Moreover, discretely uttered vowels are also referred to as "discrete vowels", and vowels continuously uttered in a sentence are also referred to as "in-sentence vowels". The inventors, as a result of diligent study, have gained new knowledge regarding a difference between vowels of the discrete utterance and vowels of the sentence utterance. This will be described below.

FIG. 1 is a schematic diagram showing an example of a vowel spectral envelope. In FIG. 1, the vertical axis indicates power, and the horizontal axis indicates frequency. As shown in FIG. 1, the vowel spectrum has plural peaks. These peaks correspond to resonance of the vocal tract. The smallest frequency peak is called the first formant. The second smallest frequency peak is called the second formant. The frequency corresponding to the smallest peak and the frequency corresponding to the second smallest peak (center frequencies) are called the first formant frequency and the second formant frequency, respectively. The types of vowels are determined mainly by the relationship between the first formant frequency and the second formant frequency.

Figure 2A:
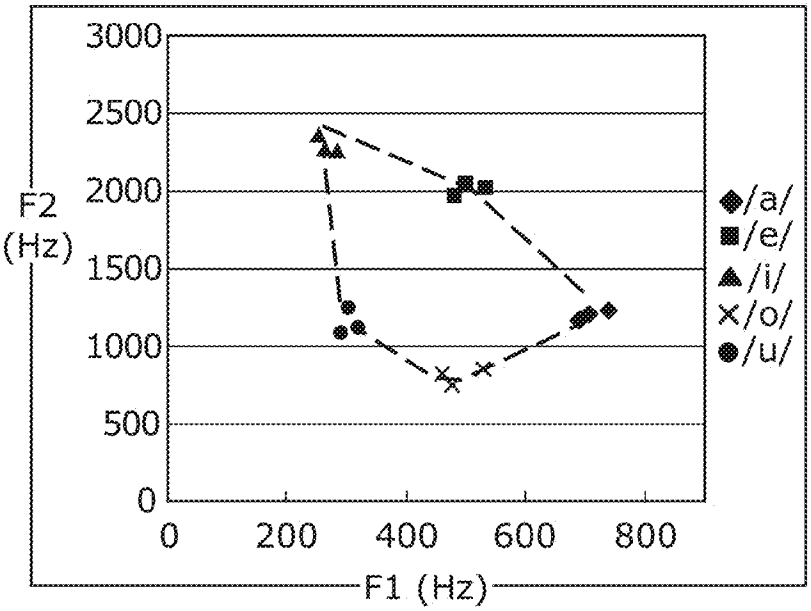
[FIG. 2A]
Figure 2B:
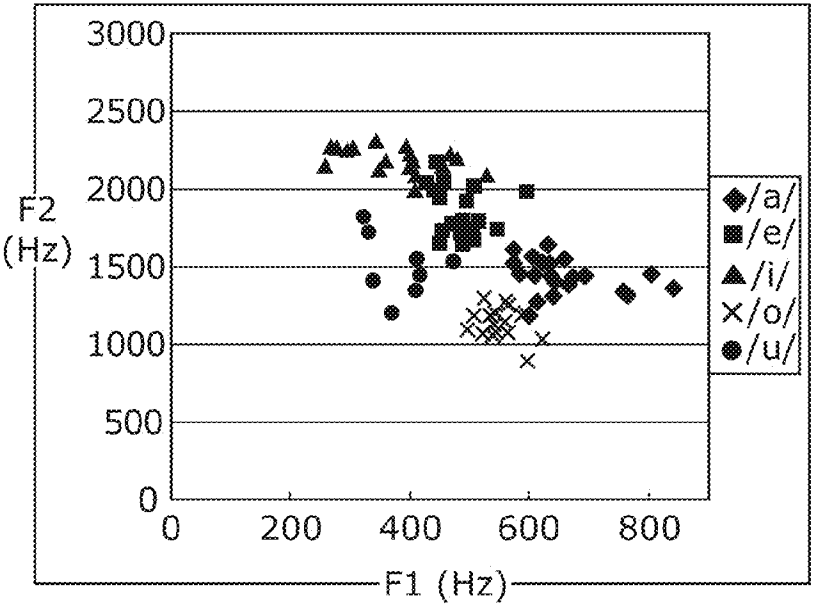
[FIG. 2B]

FIG. 2A shows distribution of the first and second formant frequencies of discrete vowels. FIG. 2B shows distribution of the first and second formant frequencies of in-sentence vowels. In FIG. 2A and FIG. 2B, the horizontal axis indicates the first formant frequency, and the vertical axis indicates the second formant frequency. The two-dimensional plane defined by the first and second formant frequencies shown in FIG. 2A and FIG. 2B are called F1-F2 plane.

More specifically, FIG. 2A shows the first and second formant frequencies of the five Japanese vowels discretely uttered by a speaker. FIG. 2B shows the first and second formant frequencies of vowels included in a Japanese sentence spoken by the same speaker in continuous utterance. In FIG. 2A and FIG. 2B, the five vowels /a/ /i/ /u/ /e/ /o/ are denoted by different symbols.

As shown in FIG. 2A, the dotted lines connecting the five discrete vowels form a pentagon. The five discrete vowels /a/ /i/ /u/ /e/ /o/ are away from each other on the F1-F2 plane. This means that the five discrete vowels /a/ /i/ /u/ /e/ /o/ have different features. For example, it is clear that the distance between the discrete vowels /a/ and /i/ is greater than the distance between the discrete vowels /a/ and /o/.

However, as shown in FIG. 2B, the five in-sentence vowels are closer to each other on the F1-F2 plane. More specifically, the positions of the in-sentence vowels shown in FIG. 2B are close to the center or the center of gravity of the pentagon as compared to the positions of the discrete vowels shown in FIG. 2A.

The in-sentence vowels are articulated with the preceding or subsequent phoneme or consonant. This causes reduction of articulation in each in-sentence vowel. Thus, each vowel included in a continuously uttered sentence is not clearly pronounced. However, the speech is smooth and natural throughout the sentence.

Conversely, articulatory movement becomes unnatural when each in-sentence vowel is clearly uttered like discrete vowels. This results in the speech being unsmooth and unnatural throughout the sentence. Thus, when combining continuous speech, it is important to use speech which simulates the reduction of articulation.

To achieve the reduction of articulation, a vowel feature value may be extracted from speech of the sentence utterance. However, this requires preparation of a large amount of speech of the sentence utterance, thereby significantly reducing the practical usability. Furthermore, the in-sentence vowels are strongly affected by the preceding and following phonemes. Unless a vowel having similar preceding and following phonemes (i.e., a vowel having a similar phonetic environment) is used, the speech lacks naturalness. Thus, a great amount of speech of the sentence utterance is required. For example, speech of several tens of sentences of the sentence utterance is insufficient.

The knowledge that the inventors have gained is (i) to obtain the feature values of discrete vowels in order to make use of the convenience that only a small amount of speech is required, and (ii) to move the feature values of the discrete vowels in the direction in which the pentagon formed by the discrete vowels on the F1-F2 plane is reduced in size, in order to simulate the reduction of articulation. Specific methods based on this knowledge will be described below.

The first method is to move each vowel toward the center of gravity of the pentagon on the F1-F2 plane. Here, a positional vector b of an i-th vowel on the F1-F2 plane is defined by Equation (1).

[Math. 1]

$$b_i=[f1_i f2_i] \tag{1}$$

Here, $f1_i$ indicates the first formant frequency of the i-th vowel, and $f2_i$ indicates the second formant frequency of the i-th vowel. i is an index representing a type of vowel. When there are five vowels, i is given as $1 \le i \le 5$.

The center of gravity g is expressed by Equation (2) below.

[Math. 2]

$$g = \frac{1}{N}\sum_{i=1}^{N} b_i \tag{2}$$

Here, N denotes the number of types of vowels. Thus, the center of gravity g is the arithmetic average of positional vectors of the vowels. Subsequently, the positional vector of the i-th vowel is converted by Equation (3) below.

[Math. 3]

$$\hat{b}_i=ag+(1-a)b_i \tag{3}$$

Here, a is a value between 0 and 1, and is an obscuration degree coefficient indicating the degree of moving the positional vectors b of the respective vowels closer to the center of gravity g. The closer the obscuration degree coefficient a is to 1, the closer to the center of gravity g all the vowels are moved. This results in a smaller difference among the positional vectors b of the respective vowels. In other words, the acoustic feature of each vowel becomes obscure on the F1-F2 plane shown in FIG. 2A.

Based on the above idea, the vowels can be obscured. However, a direct change of the formant frequencies involves problems. FIG. 2A shows the first formant frequency and the second formant frequency only. However, the discrete vowels and the in-sentence vowels are different not only in the first and second formant frequencies but also in other physical quantities. Examples of the other physical quantities include a formant frequency of an order higher than the second formant frequency and the bandwidth of each formant. Thus, when only the second formant frequencies of the vowels are changed to higher frequencies, for example, the second formant frequencies may become too close to the third formant frequencies.

As a result, there is a possibility that an abnormally sharp peak appears in the spectral envelope and that a synthetic filter oscillates or the amplitude of a synthetic sound abnormally increases. In such a case, normal speech cannot be synthesized.

When converting the voice quality of speech, the speech resulting from the conversion becomes an inadequate sound unless plural parameters representing the features of the speech are changed with their balance maintained. The plural parameters lose their balance and the voice quality significantly deteriorates when only two parameters, namely, the first formant frequency and the second formant frequency, are changed.

To solve this problem, the inventors have found a method of obscuring vowels by changing the vocal tract shape instead of by directly changing the formant frequencies.

(Vocal Tract Cross-Sectional Area Function)

Figure 3:
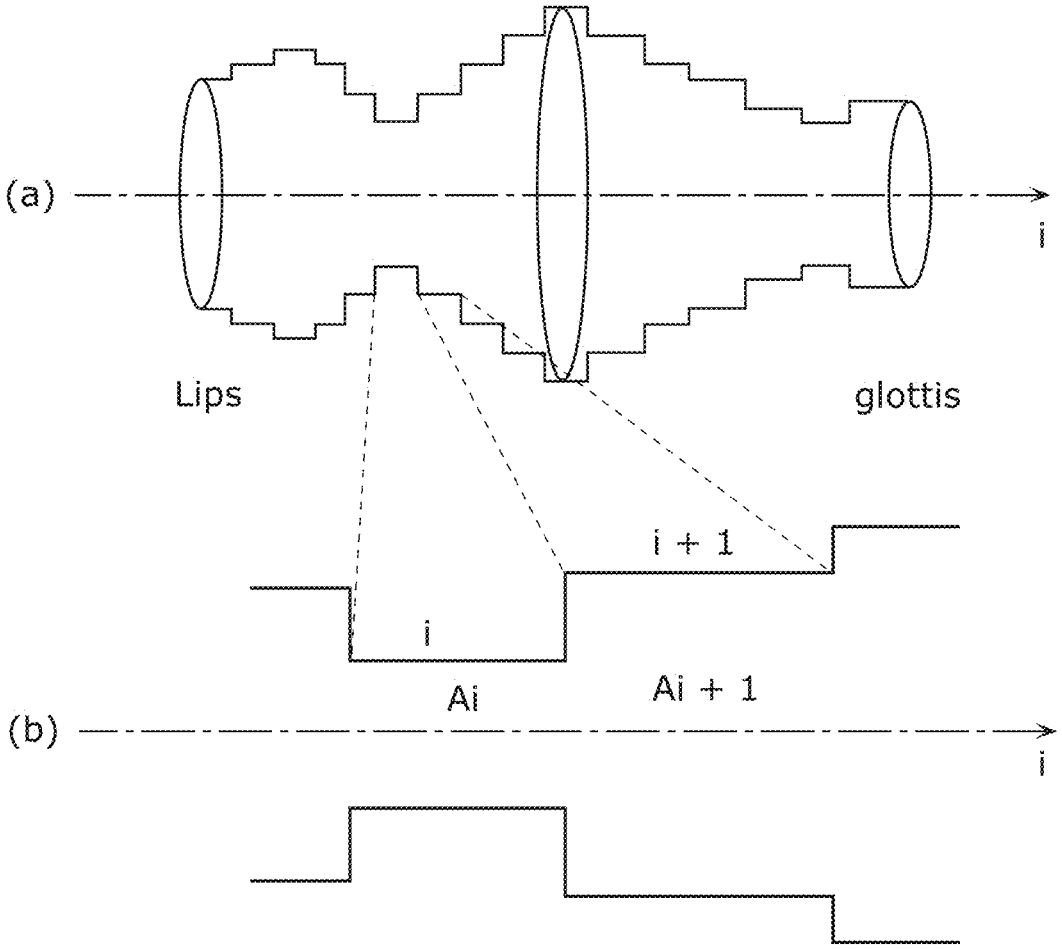
[FIG. 3]

An example of information indicating a vocal tract shape (hereinafter referred to as "vocal tract shape information") is a vocal tract cross-sectional area function. FIG. 3 shows an acoustic tube model of a human vocal tract. The human vocal tract is a space from the vocal cords to the lips.

In (a) of FIG. 3, the vertical axis indicates the size of the cross-sectional area, and the horizontal axis indicates the section number of the acoustic tubes. The section number of the acoustic tubes indicates a position in the vocal tract. The left edge of the horizontal axis corresponds to the position of the lips, and the right edge of the horizontal axis corresponds to the position of the glottis.

In the acoustic tube model shown in (a) of FIG. 3, plural circular acoustic tubes are connected in series. The vocal tract shape is simulated using the cross-sectional area of the vocal tract as the cross-sectional area of the acoustic tube of each section. Here, the relationship between a position in the length direction of the vocal tract and the size of the cross-sectional area corresponding to that position is called vocal tract cross-sectional area function.

It is known that the cross-sectional area of the vocal tract uniquely corresponds to a partial auto correlation (PARCOR) coefficient based on linear predictive coding (LPC) analysis. By Equation (4) below, a PARCOR coefficient can be converted into a cross-sectional area of the vocal tract. Hereinafter, a PARCOR coefficient k; will be described as an example of the vocal tract shape information. However, the vocal tract shape information is not limited to the PARCOR coefficient, and may be line spectrum pairs (LSP) or LPC equivalent to the PARCOR coefficient. It is to be noted that the only difference between a reflection coefficient and the PARCOR coefficient between the acoustic tubes in the above-described acoustic tube model is that the sign is reverse. Thus, the reflection coefficient may be used as the vocal tract shape information.

[Math. 4]

$$\frac{A_i}{A_{i+1}} = \frac{1-k_i}{1+k_i} \tag{4}$$

Here, $A_i$ is the cross-sectional area of an acoustic tube in the i-th section shown in (b) of FIG. 3, and k; represents a PARCOR coefficient (reflection coefficient) at the boundary between the i-th section and the i+1-th section.

The PARCOR coefficient can be calculated using a linear predictive coefficient $\alpha_i$ analyzed using LPC analysis. More specifically, the PARCOR coefficient is calculated using the Levinson-Durbin-Itakura algorithm. It is to be noted that the PARCOR coefficient has the following characteristics:

Although the linear predictive coefficient depends on an analysis order p, the stability of the PARCOR coefficient does not depend on the number of the order of analysis.

Variations in the value of a lower order coefficient have a larger influence on the spectrum, and variations in the value of a higher order coefficient have a smaller influence on the spectrum.

The influence of the variations in the value of a higher order coefficient on the spectrum is even over the entire frequency band.

It is to be noted that the vocal tract shape information need not be information indicating a cross-sectional area of the vocal tract, and may be information indicating the volume of each section of the vocal tract.

(Change of Vocal Tract Shape)

Next, change of the vocal tract shape will be described. As described earlier, the shape of the vocal tract can be determined from the PARCOR coefficient shown in Equation (4). Here, plural pieces of vocal tract shape information are combined to change the vocal tract shape. More specifically, instead of calculating the weighted average of plural vocal tract cross-sectional area functions, the weighted average of plural PARCOR coefficient vectors is calculated. The PARCOR coefficient vector of the i-th vowel can be expressed by Equation(5) , where M defines the analysis order.

[Math. 5]

$$k_i=(k_1^i\, k_2^i \ldots k_M^i) \tag{5}$$

The weighted average of the PARCOR coefficient vectors of plural vowels can be calculated by Equation (6).

[Math. 6]

$$\bar{k} = \sum_i w_i k_i \tag{6}$$

$$\sum_i w_i = 1$$

Here, $w_i$ is a weighting factor. When two pieces of vocal tract shape information on vowels are to be combined, the weighting factor corresponds to a combination ratio of the two pieces of vocal tract shape information.

(Obscuration of Vocal Tract Shape Information)

Next, the following describes the steps for combining plural pieces of vocal tract shape information on vowels in order to obscure a vowel.

First, average vocal tract shape information on N types of vowels is calculated by Equation (7). More specifically, the arithmetic average of values (here, PARCOR coefficients) indicated by the vocal tract shape information on the respective vowels is calculated to generate the average vocal tract shape information.

[Math. 7]

$$\bar{k} = \frac{1}{N}\sum_{i=0}^{N-1} k_i \tag{7}$$

Next, the vocal tract shape information on the i-th vowel is converted into obscured vocal tract shape information using the obscuration degree coefficient a of the i-th vowel. More specifically, the obscured vocal tract shape information is generated for each vowel by making the value indicated by the vocal tract shape information on the vowel approximate the value indicated by the average vocal tract shape information. That is to say, the obscured vocal tract shape information is generated by combining the vocal tract shape information on the i-th vowel and the vocal tract shape information on one or more vowels.

[Math. 8]

$$\hat{k}_i = a\bar{k} + (1-a)k_i \quad (8)$$

$k_i$: Vocal tract shape information on a vowel before obscuration, $\hat{k}_i$: Vocal tract shape information on a vowel after obscuration Combining speech using the obscured vocal tract shape information on a vowel generated in the above manner enables reproduction of reduction of articulation without deteriorating the sound quality.

Hereinafter, the result of an actual experiment will be described.

Figure 4A:
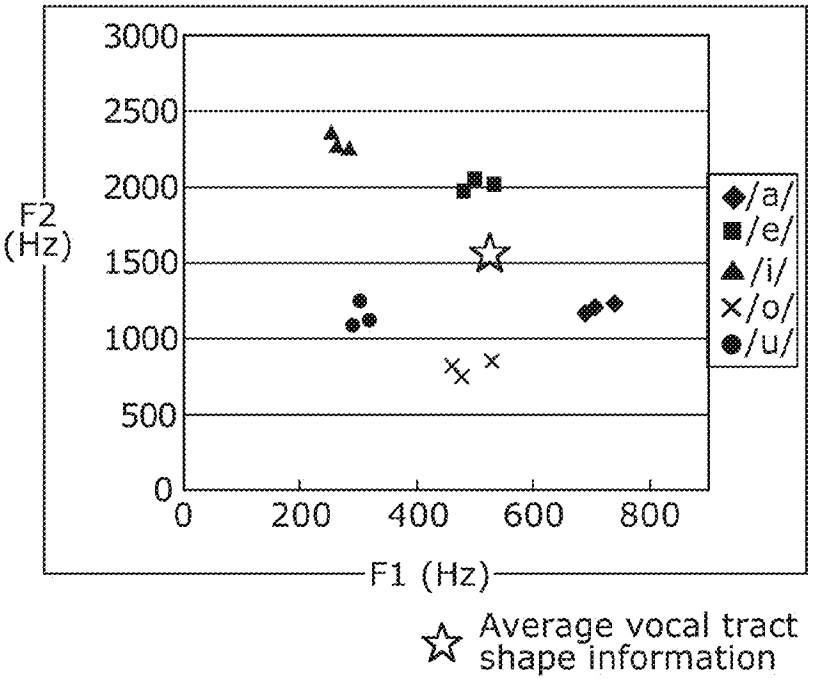
[FIG. 4A]
Figure 4B:
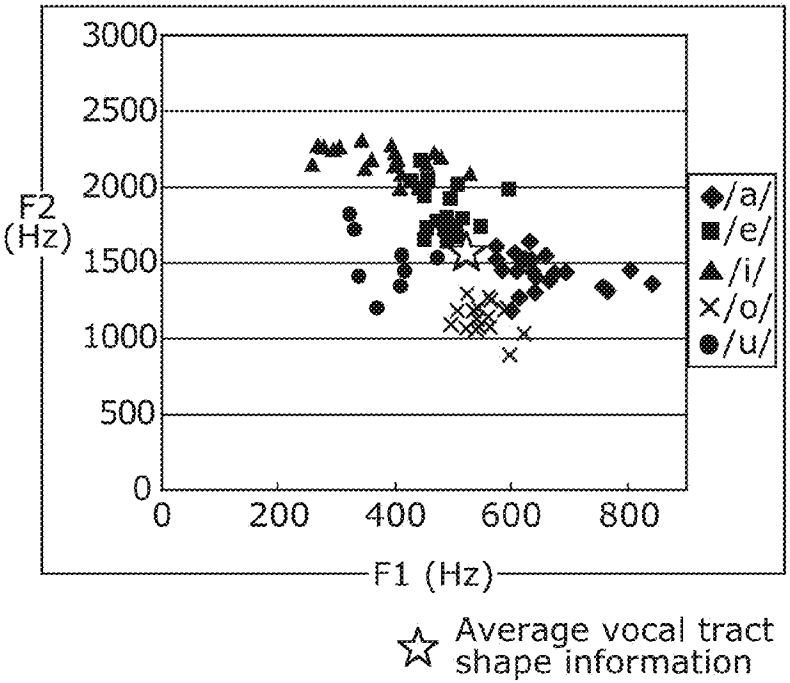
[FIG. 4B]

FIG. 4A shows a relationship between discrete vowels and the average vocal tract shape information. FIG. 4B shows a relationship between in-sentence vowels and the average vocal tract shape information. In FIG. 4A and FIG. 4B, the average vocal tract shape information is calculated according to Equation (7) using the information on the discrete vowels shown in FIG. 2A. It is to be noted that the stars shown in FIG. 4A and FIG. 4B each indicate the first and second formant frequencies of a vowel synthesized using the average vocal tract shape information.

In FIG. 4A, the average vocal tract shape information is located near the center of gravity of the pentagon formed by the five vowels. In FIG. 4B, the average vocal tract shape information is located near the center of the region in which the in-sentence vowels are distributed.

Figure 5B:
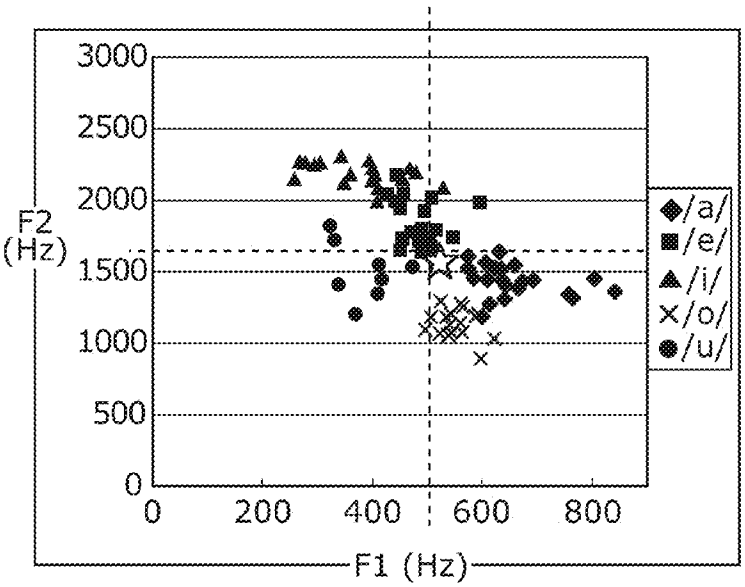
[FIG. 5B]
Figure 5A:
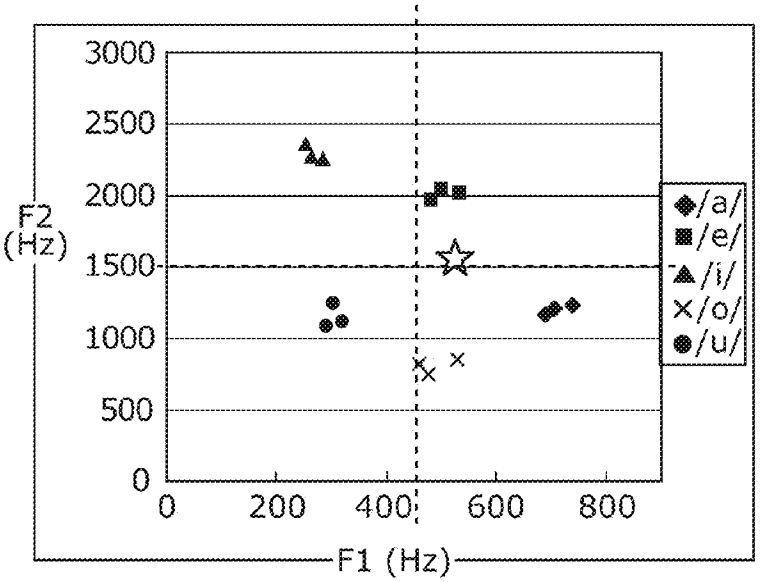
[FIG. 5A]

FIG. 5A shows the average of the first and second formant frequencies of the discrete vowels (15 vowels shown in FIG. 2A). FIG. 5B shows the average of the first and second formant frequencies of the in-sentence vowels (95 vowels shown in FIG. 2B). Hereinafter, the average of the first and second formant frequencies is also called F1-F2 average.

In FIG. 5A and FIG. 5B, the average of the first formant frequency and the average of the second formant frequency are shown with dashed lines. FIG. 5A and FIG. 5B also show the stars indicating the average vocal tract shape information shown in FIG. 4A and FIG. 4B.

The position of the average vocal tract shape information calculated using Equation (7) and shown in FIG. 4A is closer to the position of the F1-F2 average of the in-sentence vowels shown in FIG. 5B than to the position of the F1-F2 average of the discrete vowels shown in FIG. 5A. Thus, the degree of approximation of the average vocal tract shape information calculated using Equation (7) and Equation (8) to the actual reduction of articulation is greater than the degree of approximation of the average vocal tract shape information to the F1-F2 average of the discrete vowels. Hereinafter, a description will be provided using specific coordinate values.

FIG. 6 shows the root mean square error (RMSE) between (i) each of the F1-F2 average of the in-sentence vowels, the F1-F2 average of the discrete vowels, and the average vocal tract shape information and (ii) the first and second formant frequencies of plural in-sentence vowels.

As shown in FIG. 6, the RMSE of the average vocal tract shape information is closer to the RMSE of the F1-F2 average of the in-sentence vowels than to the RMSE of the F1-F2 average of the discrete vowels. Although the closeness of the RMSE cannot be considered as the only factor contributing to the speech naturalness, it can be considered as an index representing the degree of approximation to the reduction of articulation.

Figure 7:
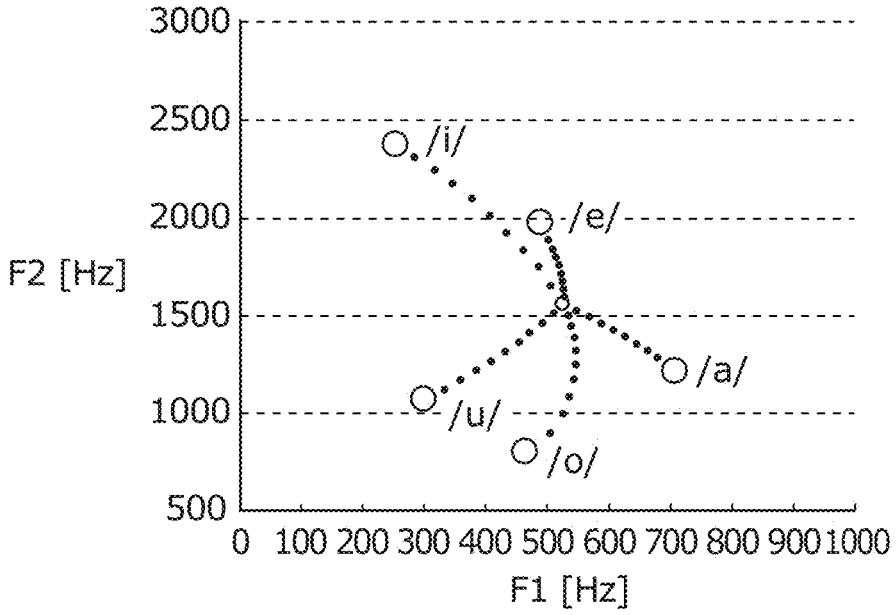
[FIG. 7]

Next, FIG. 7 illustrates the effect of moving the position of each discrete vowel on the F1-F2 plane toward the position of the average vocal tract shape information using Equation (8). In FIG. 7, the large white circles each indicate the position of a vowel when a=0, the small white circle indicates the position of each vowel when a=1, that is, the small white circle indicates the position corresponding to the average vocal tract shape, and the black points each indicate the position of a vowel when a is increased by 0.1 increments. All the vowels are continuously moved toward the position corresponding to the average vocal tract shape. The inventors have found that changing the vocal tract shape by combining plural pieces of the vocal tract shape information allows the first and second formant frequencies to be averaged and obscured.

In view of this, a voice quality conversion system according to an exemplary embodiment disclosed herein is a voice quality conversion system which converts a voice quality of input speech using vocal tract shape information indicating a shape of a vocal tract, the system including: a vowel receiving unit configured to receive sounds of plural vowels of different types; an analysis unit configured to analyze the sounds of the plural vowels received by the vowel receiving unit to generate first vocal tract shape information for each type of the vowels; a combination unit configured to combine, for each type of the vowels, the first vocal tract shape information on the type of vowel and the first vocal tract shape information on a different type of vowel to generate second vocal tract shape information on the type of vowel; and a synthesis unit configured to (i) obtain vocal tract shape information and voicing source information on the input speech, (ii) combine vocal tract shape information on a vowel included in the input speech and the second vocal tract shape information on a same type of vowel as the vowel included in the input speech to convert the vocal tract shape information on the input speech, and (iii) generate a synthetic sound using the vocal tract shape information on the input speech resulting from the conversion and the voicing source information on the input speech to convert the voice quality of the input speech.

With this configuration, the second vocal tract shape information can be generated for each type of vowels by combining plural pieces of the first vocal tract shape information. That is to say, the second vocal tract shape information can be generated for each type of vowels using a small number of speech samples. The second vocal tract shape information generated in this manner for each type of vowels corresponds to the vocal tract shape information on that type of vowel which has been obscured. This means that the voice quality conversion on the input speech using the second vocal tract shape information allows the input speech to be converted into smooth and natural speech.

For example, the combination unit may include: an average vocal tract information calculation unit configured to calculate a piece of average vocal tract shape information by averaging plural pieces of the first vocal tract shape information generated for respective types of the vowels; and a combined vocal tract information generation unit configured to combine, for each type of the vowels received by the vowel receiving unit, the first vocal tract shape information on the type of vowel and the average vocal tract shape information to generate the second vocal tract shape information on the type of vowel.

With this configuration, the second vocal tract shape information can be easily approximated to the average vocal tract shape information.

For example, the average vocal tract information calculation unit may be configured to calculate the average vocal tract shape information by calculating a weighted arithmetic average of the plural pieces of the first vocal tract shape information.

With this configuration, the weighted arithmetic average of the plural pieces of the first vocal tract shape information can be calculated as the average vocal tract shape information. Thus, assigning a weight to the first vocal tract shape information according to the feature of the reduction of articulation of the target speaker, for example, allows the input speech to be converted into more smooth and natural speech of the target speaker.

For example, the combination unit may be configured to generate the second vocal tract shape information in such a manner that as a local speech rate for a vowel included in the input speech increases, a degree of approximation of the second vocal tract shape information on a same type of vowel as the vowel included in the input speech to an average of plural pieces of the first vocal tract shape information generated for respective types of the vowels increases.

With this configuration, a combination ratio of plural pieces of the first vocal tract shape information can be set according to the local speech rate for a vowel included in the input speech. The obscuration degrees of the in-sentence vowels depend on the local speech rate. Thus, it is possible to convert the input speech into more smooth and natural speech.

For example, the combination unit may be configured to combine, for each type of the vowels, the first vocal tract shape information on the type of vowel and the first vocal tract shape information on a different type of vowel at a combination ratio set for the type of vowel.

With this configuration, the combination ratio of plural pieces of the first vocal tract shape information can be set for each type of vowels. The obscuration degrees of the in-sentence vowels depend on the type of vowels. Thus, it is possible to convert the input speech into more smooth and natural speech.

For example, the combination unit may be configured to combine, for each type of the vowels, the first vocal tract shape information on the type of vowel and the first vocal tract shape information on a different type of vowel at a combination ratio set by a user.

With this configuration, the obscuration degrees of plural vowels can be set according to the user's preferences.

For example, the combination unit may be configured to combine, for each type of the vowels, the first vocal tract shape information on the type of vowel and the first vocal tract shape information on a different type of vowel at a combination ratio set according to a language of the input speech.

With this configuration, the combination ratio of plural pieces of the first vocal tract shape information can be set according to the language of the input speech. The obscuration degrees of the in-sentence vowels depend on the language of the input speech. Thus, it is possible to set an obscuration degree appropriate for each language.

For example, the voice quality conversion system may further include an input speech storage unit configured to store the vocal tract shape information and the voicing source information on the input speech, and the synthesis unit may be configured to obtain the vocal tract shape information and the voicing source information on the input speech from the input speech storage unit.

A vocal tract information generation device according to an exemplary embodiment disclosed herein is a vocal tract information generation device which generates vocal tract shape information indicating a shape of a vocal tract and used for converting a voice quality of input speech, the device including: an analysis unit configured to analyze sounds of plural vowels of different types to generate first vocal tract shape information for each type of the vowels; and a combination unit configured to combine, for each type of the vowels, the first vocal tract shape information on the type of vowel and the first vocal tract shape information on a different type of vowel to generate second vocal tract shape information on the type of vowel.

With this configuration, the second vocal tract shape information can be generated for each type of vowels by combining plural pieces of the first vocal tract shape information. That is to say, the second vocal tract shape information can be generated for each type of vowels using a small number of speech samples. The second vocal tract shape information generated in this manner for each type of vowels corresponds to the vocal tract shape information on that type of vowel which has been obscured. This means that outputting the second vocal tract shape information to the voice quality conversion device allows the voice quality conversion device to convert the input speech into smooth and natural speech using the second vocal tract shape information.

The vocal tract information generation device may further include a synthesis unit configured to generate a synthetic sound for each type of the vowels using the second vocal tract shape information; and an output unit configured to output the synthetic sound as speech.

With this configuration, the synthetic sound generated for each type of vowels using the second vocal tract shape information can be outputted as speech. Thus, the input speech can be converted into smooth and natural speech using a conventional voice quality conversion device.

A voice quality conversion device according to an exemplary embodiment disclosed herein is a voice quality conversion device which converts a voice quality of input speech using vocal tract shape information indicating a shape of a vocal tract, the device including: a vowel vocal tract information storage unit configured to store second vocal tract shape information generated by combining, for each type of vowels, first vocal tract shape information on the type of vowel and the first vocal tract shape information on a different type of vowel; and a synthesis unit configured to (i) combine vocal tract shape information on a vowel included in the input speech and the second vocal tract shape information on a same type of vowel as the vowel included in the input speech to convert vocal tract shape information on the input speech, and (ii) generate a synthetic sound using the vocal tract shape information on the input speech resulting from the conversion and voicing source information on the input speech to convert the voice quality of the input speech.

With this configuration, it is possible to achieve the same advantageous effect as that of the above-described voice quality conversion system.

These general and specific aspects may be implemented using a method, an integrated circuit, a computer program, or a computer-readable recording medium such as a CD-ROM, or any combination of methods, integrated circuits, computer programs, or recording media.

Hereinafter, certain exemplary embodiments will be described in greater detail with reference to the accompanying Drawings.

Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of the appended Claims and their equivalents. Furthermore, among the structural elements in the following embodiments, structural elements not recited in any one of the independent claims representing the most generic concepts are described as arbitrary structural elements.

(Embodiment 1)

Figure 8:
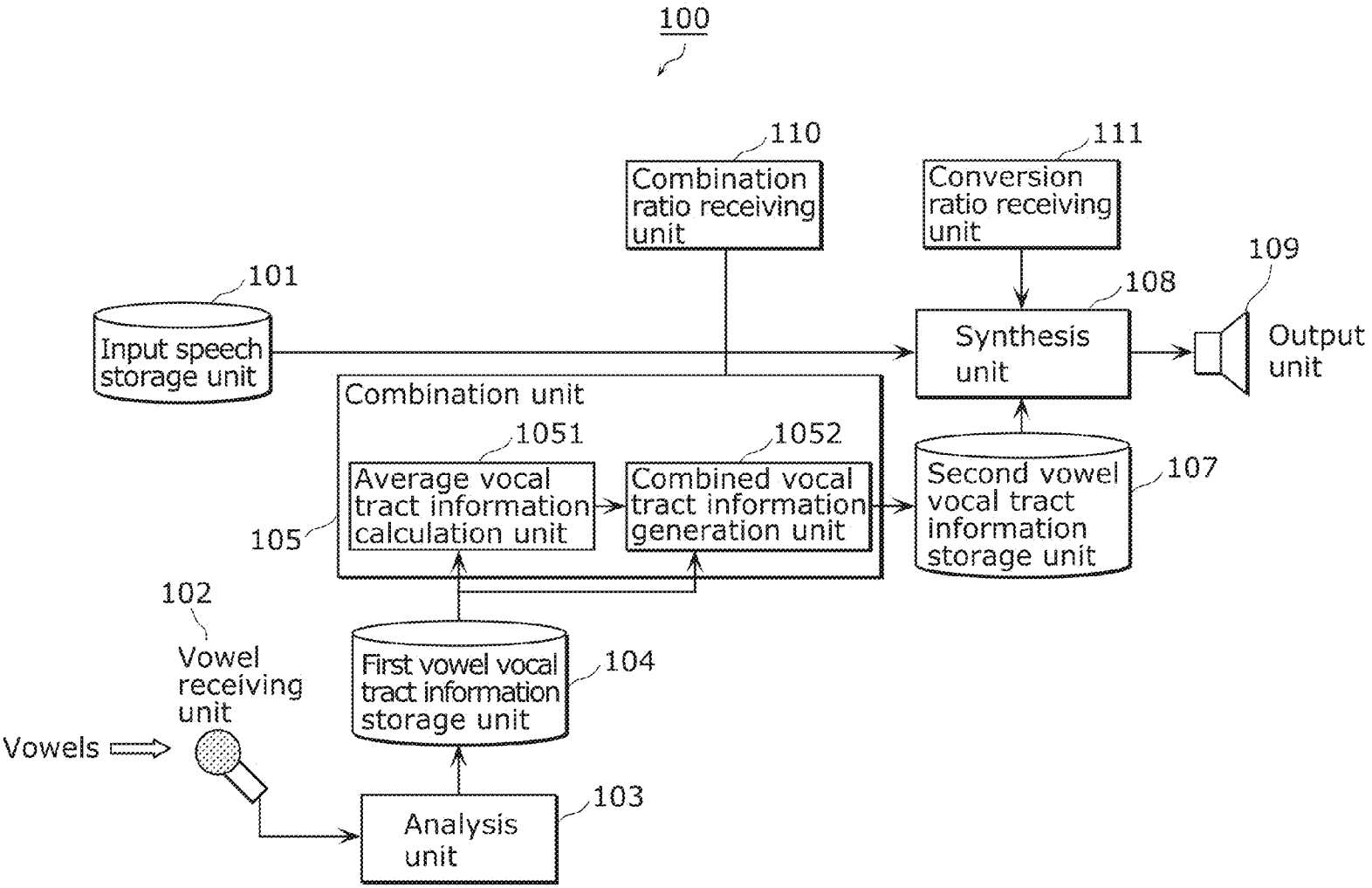
[FIG. 8]

FIG. 8 is a configuration diagram of a voice quality conversion system 100 according to Embodiment 1.

The voice quality conversion system 100 converts the voice quality of input speech using vocal tract shape information indicating the shape of vocal tract. As shown in FIG. 8, the voice quality conversion system 100 includes an input speech storage unit 101, a vowel receiving unit 102, an analysis unit 103, a first vowel vocal tract information storage unit 104, a combination unit 105, a second vowel vocal tract information storage unit 107, a synthesis unit 108, an output unit 109, a combination ratio receiving unit 110, and a conversion ratio receiving unit 111. These structural elements are connected by wired or wireless connection and receive and transmit information from and to each other. Hereinafter, each structural element will be described.

(Input Speech Storage Unit 101)

The input speech storage unit 101 stores input speech information and attached information associated with the input speech information. The input speech information is information related to input speech which is the subject of the conversion. More specifically, the input speech information is audio information constituted by plural phonemes. For example, the input speech information is prepared by recording in advance the audio and the like of a song sung by a singer. To be more specific, the input speech storage unit 101 stores the input speech information by storing vocal tract information and voicing source information separately.

The attached information includes time information indicating the boundaries of phonemes in the input speech and information on the types of phonemes.

(Vowel Receiving Unit 102)

The vowel receiving unit 102 receives sounds of vowels. In the present embodiment, the vowel receiving unit 102 receives sounds of plural vowels of (i) different types and (ii) the same language as the input speech. As the sounds of plural vowels of different types, it is sufficient as long as sounds of plural vowels of different types are included, and may include sounds of plural vowels of the same type.

The vowel receiving unit 102 transmits, to the analysis unit 103, an acoustic signal of a vowel that is an electric signal corresponding to the sound of the vowel.

The vowel receiving unit 102 includes a microphone in the case of receiving speech of a speaker, for example. The vowel receiving unit 102 includes an audio circuit and an analog-to-digital converter in the case of receiving an acoustic signal which has been converted into an electric signal in advance, for example. The vowel receiving unit 102 includes a data reader in the case of receiving acoustic data obtained by converting an acoustic signal into digital data in advance, for example.

It is to be noted that the vowel receiving unit 102 may include a display unit. The display unit displays (i) a single vowel or sentence to be uttered by the target speaker and (ii) when to utter.

Furthermore, the speech received by the vowel receiving unit 102 may be discretely uttered vowels. For example, the vowel receiving unit 102 may receive acoustic signals of representative vowels. Representative vowels differ depending on the language. For example, the Japanese representative vowels are the five types of vowels, namely, /a/ /i/ /u/ /e/ /o/. The English representative vowels are the 13 types of vowels shown below in the International Phonetic Alphabet (IPA).

[Math. 9]

[i][ʉ][ɪ][ʊ][e][o][ə][ɛ][ʌ][ɔ][æ][ɑ][ɒ]

When receiving sounds of the Japanese vowels, for example, the vowel receiving unit 102 makes the target speaker discretely utter the five types of vowels, /a/ /i/ /u/ /e/ /o/, (that is, makes the target speaker utter the vowels with intervals in between). Making the speaker discretely utter the vowels in such a manner allows the analysis unit 103 to extract vowel segments using power information.

However, the vowel receiving unit 102 need not receive the sounds of discretely uttered vowels. The vowel receiving unit 102 may receive vowels continuously uttered in a sentence. For example, when a speaker feeling nervous has intentionally uttered speech clearly, even the vowels continuously uttered in a sentence may sound similar to discretely uttered vowels. In the case of receiving vowels of the sentence utterance, it is sufficient as long as the vowel receiving unit 102 makes the speaker utter a sentence including the five vowels, for example (e.g., "Honjitsu wa seiten nari" (It's fine today)). In this case, the analysis unit 103 can extract vowel segments with an automatic phoneme segmentation technique using Hidden Markov Model (HMM) or the like.

(Analysis Unit 103)

The analysis unit 103 receives the acoustic signals of vowels from the vowel receiving unit 102. The analysis unit 103 assigns attached information to the acoustic signals of the vowels received by the vowel receiving unit 102. Furthermore, the analysis unit 103 separates the acoustic signal of each vowel into the vocal tract information and the voicing source information by analyzing the acoustic signal of each vowel using an analysis method such as Linear Predictive Coding (LPC) analysis or Auto-regressive Exogenous (ARX) analysis.

The vocal tract information includes vocal tract shape information indicating the shape of the vocal tract when a vowel is uttered. The vocal tract shape information included in the vocal tract information and separated by the analysis unit 103 is called first vocal tract shape information. More specifically, the analysis unit 103 analyzes the sounds of plural vowels received by the vowel receiving unit 102, to generate the first vocal tract shape information for each type of vowels.

Examples of the first vocal tract shape information include, apart from the above-described LPC, a PARCOR coefficient and Line Spectrum Pairs (LSP) equivalent to the PARCOR coefficient. It is to be noted that the only difference between a reflection coefficient and the PARCOR coefficient between the acoustic tubes in the acoustic tube model is that the sign is reverse. Thus, the reflection coefficient may be used as the first vocal tract shape information.

The attached information includes the type of each vowel (e.g., /a/ /i/) and a time at the center of a vowel segment. The analysis unit 103 stores, for each type of vowels, at least the first vocal tract shape information on that type of vowel in the first vowel vocal tract information storage unit 104.

Next, the following describes an example of a method of generating the first vocal tract shape information on a vowel.

Figure 9:
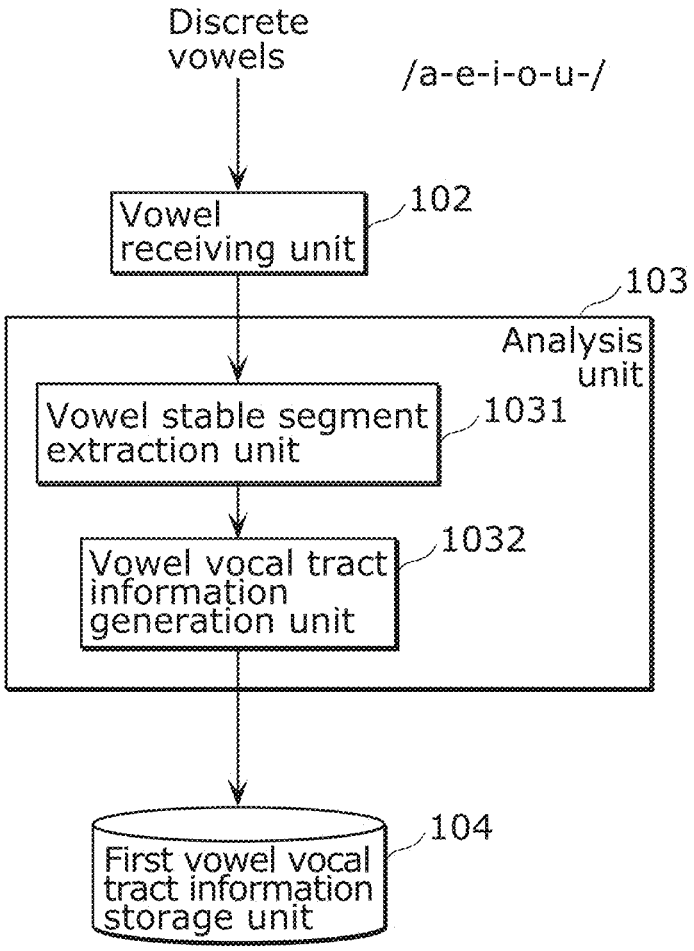
[FIG. 9]

FIG. 9 shows an example of a detailed configuration of the analysis unit 103 according to Embodiment 1. The analysis unit 103 includes a vowel stable segment extraction unit 1031 and a vowel vocal tract information generation unit 1032.

The vowel stable segment extraction unit 1031 extracts a discrete vowel segment (vowel segment) from speech including an input vowel to calculate a time at the center of the vowel segment. It is to be noted that the method of extracting the vowel segment need not be limited to this. For example, the vowel stable segment extraction unit 1031 may determine a segment as a stable segment when the segment has power equal to or greater than a certain level, and extract the stable segment as the vowel segment.

For the center of the vowel segment of the discrete vowel extracted by the vowel stable segment extraction unit 1031, the vowel vocal tract information generation unit 1032 generates the vocal tract shape information on the vowel. For example, the vowel vocal tract information generation unit 1032 calculates the above-mentioned PARCOR coefficient as the first vocal tract shape information. The vowel vocal tract information generation unit 1032 stores the first vocal tract shape information on the vowel in the first vowel vocal tract information storage unit 104.

(First Vowel Vocal Tract Information Storage Unit 104)

The first vowel vocal tract information storage unit 104 stores, for each type of vowels, at least the first vocal tract shape information on that type of vowel. More specifically, the first vowel vocal tract information storage unit 104 stores plural pieces of the first vocal tract shape information generated for the respective types of vowels by the analysis unit 103.

(Combination Unit 105)

The combination unit 105 combines, for each type of vowels, the first vocal tract shape information on that type of vowel and the first vocal tract shape information on a different type of vowel to generate second vocal tract shape information on that type of vowel. More specifically, the combination unit 105 generates the second vocal tract shape information for each type of vowels in such a manner that the degree of approximation of the second vocal tract shape information on that type of vowel to the average vocal tract shape information is greater than the degree of approximation of the second vocal tract shape information on that type of vowel to the first vocal tract shape information on that type of vowel. The second vocal tract shape information generated in such a manner corresponds to the obscured vocal tract shape information.

It is to be noted that the average vocal tract shape information is the average of the plural pieces of the first vocal tract shape information generated for the respective types of vowels. Furthermore, combining the plural pieces of the vocal tract shape information means calculating a weighted sum of values or vectors indicated by the respective pieces of the vocal tract shape information.

Here, an example of a detailed configuration of the combination unit 105 will be described. The combination unit 105 includes an average vocal tract information calculation unit 1051 and a combined vocal tract information generation unit 1052, for example.

(Average Vocal Tract Information Calculation Unit 1051)

The average vocal tract information calculation unit 1051 obtains the plural pieces of the first vocal tract shape information stored in the first vowel vocal tract information storage unit 104. The average vocal tract information calculation unit 1051 calculates a piece of average vocal tract shape information by averaging the obtained plural pieces of the first vocal tract shape information. The specific processing will be described later. The average vocal tract information calculation unit 1051 transmits the average vocal tract shape information to the combined vocal tract information generation unit 1052.

(Combined Vocal Tract Information Generation Unit 1052)

The combined vocal tract information generation unit 1052 receives the average vocal tract shape information from the average vocal tract information calculation unit 1051. Furthermore, the combined vocal tract information generation unit 1052 obtains the plural pieces of the first vocal tract shape information stored in the first vowel vocal tract information storage unit 104.

The combined vocal tract information generation unit 1052 then combines, for each type of vowels received by the vowel receiving unit 102, the first vocal tract shape information on that type of vowel and the average vocal tract shape information to generate the second vocal tract shape information on that type of vowel. More specifically, the combined vocal tract information generation unit 1052 approximates, for each type of vowels, the first vocal tract shape information to the average vocal tract shape information to generate the second vocal tract shape information.

It is sufficient as long as the combination ratio of the first vocal tract shape information and the average vocal tract shape information is set according to the obscuration degree of a vowel. In the present embodiment, the combination ratio corresponds to the obscuration degree coefficient a in Equation (8). That is to say, the larger the combination ratio is, the higher the obscuration degree is. The combined vocal tract information generation unit 1052 combines the first vocal tract shape information and the average vocal tract shape information at the combination ratio received from the combination ratio receiving unit 110.

It is to be noted that the combined vocal tract information generation unit 1052 may combine the first vocal tract shape information and the average vocal tract shape information at a combination ratio stored in advance. In this case, the voice quality conversion system 100 need not include the combination ratio receiving unit 110.

When the second vocal tract shape information on a type of vowel is approximated to the average vocal tract shape information, the second vocal tract shape information on that type of vowel becomes similar to the second vocal tract shape information on another type of vowel. That is to say, setting the combination ratio to a ratio at which the degree of approximation of the second vocal tract shape information to the average vocal tract shape information increases allows the combined vocal tract information generation unit 1052 to generate more obscured second vocal tract shape information. The synthetic sound generated using such more obscured second vocal tract shape information is speech lacking in articulation. For example, when the voice quality of the input speech is to be converted into a voice of a child, it is effective to set a combination ratio at which the second vocal tract shape information approximates the average vocal tract shape information as described above.

Furthermore, when the degree of approximation of the second vocal tract shape information to the average vocal tract shape information is not so high, the second vocal tract shape information is similar to the vocal tract shape information on a discrete vowel. For example, when the voice quality of the input speech is to be converted to a singing voice having a tendency to clearly articulate with the mouth wide open, it is suitable to set a combination ratio which prevents a high degree of approximation of the second vocal tract shape information to the average vocal tract shape information.

The combined vocal tract information generation unit 1052 stores the second vocal tract shape information on each type of vowels in the second vowel vocal tract information storage unit 107.

(Second Vowel Vocal Tract Information Storage Unit 107)

The second vowel vocal tract information storage unit 107 stores the second vocal tract shape information for each type of vowels. More specifically, the second vowel vocal tract information storage unit 107 stores the plural pieces of the second vocal tract shape information generated for the respective types of vowels by the combination unit 105.

(Synthesis Unit 108)

The synthesis unit 108 obtains the input speech information stored in the input speech storage unit 101. The synthesis unit 108 also obtains the second vocal tract shape information on each type of vowels stored in the second vowel vocal tract information storage unit 107.

Then, the synthesis unit 108 combines the vocal tract shape information on a vowel included in the input speech information and the second vocal tract shape information on the same type of vowel as the vowel included in the input speech information, to convert vocal tract shape information on the input speech. After that, the synthesis unit 108 generates a synthetic sound using the vocal tract shape information on the input speech resulting from the conversion and the voicing source information on the input speech stored in the input speech storage unit 101, to convert the voice quality of the input speech.

More specifically, the synthesis unit 108 combines the vocal tract shape information on a vowel included in the input speech information and the second vocal tract shape information on the same type of vowel, using, as a combination ratio, a conversion ratio received from the conversion ratio receiving unit 111. It is sufficient as long as the conversion ratio is set according to the degree of change to be made to the input speech.

It is to be noted that the synthesis unit 108 may combine the vocal tract shape information on a vowel included in the input speech information and the second vocal tract shape information on the same type of vowel, using a conversion ratio stored in advance. In this case, the voice quality conversion system 100 need not include the conversion ratio receiving unit 111.

The synthesis unit 108 transmits a signal of the synthetic sound generated in the above manner to the output unit 109.

Here, an example of a detailed configuration of the synthesis unit 108 will be described. It is to be noted that the detailed configuration of the synthesis unit 108 hereinafter described is similar to the configuration according to PTL 2.

Figure 10:
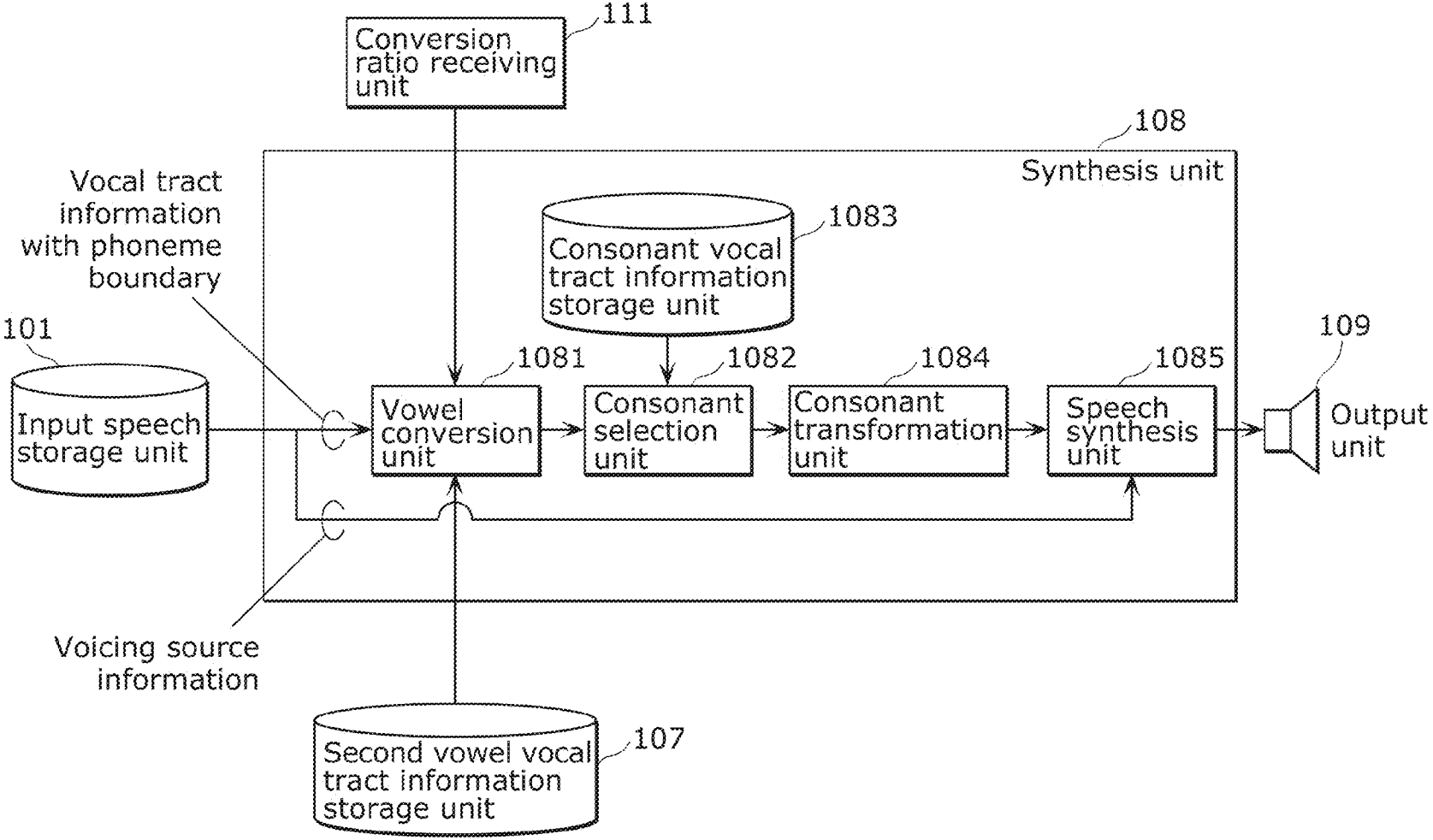
[FIG. 10]

FIG. 10 shows an example of a detailed configuration of the synthesis unit 108 according to Embodiment 1. The synthesis unit 108 includes a vowel conversion unit 1081, a consonant selection unit 1082, a consonant vocal tract information storage unit 1083, a consonant transformation unit 1084, and a speech synthesis unit 1085.

The vowel conversion unit 1081 obtains (i) vocal tract information with phoneme boundary and (ii) voicing source information from the input speech storage unit 101.

The vocal tract information with phoneme boundary is the vocal tract information on the input speech added with (i) phoneme information corresponding to the input speech and (ii) information on the duration of each phoneme. The vowel conversion unit 1081 reads, for each vowel segment, the second vocal tract shape information on a relevant vowel from the second vowel vocal tract information storage unit 107. Then, the vowel conversion unit 1081 combines the vocal tract shape information on each vowel segment and the read second vocal tract shape information to perform the voice quality conversion on the vowels of the input speech. The degree of conversion here is based on the conversion ratio received from the conversion ratio receiving unit 111.

The consonant selection unit 1082 selects vocal tract information on a consonant from the consonant vocal tract information storage unit 1083, with flow from the preceding vowel and to the subsequent vowel taken into consideration. Then, the consonant transformation unit 1084 transforms the selected vocal tract information on the consonant to provide a smooth flow from the preceding vowel and to the subsequent vowel. The speech synthesis unit 1085 generates a synthetic sound using the voicing source information obtained from the input speech storage unit 101 and the vocal tract information obtained through the transformation performed by the vowel conversion unit 1081, the consonant selection unit 1082, and the consonant transformation unit 1084.

In such a manner, the target vowel vocal tract information according to PTL 2 is replaced with the second vocal tract shape information to perform the voice quality conversion.

(Output Unit 109)

The output unit 109 receives a synthetic sound signal from the synthesis unit 108. The output unit 109 outputs the synthetic sound signal as a synthetic sound. The output unit 109 includes a speaker, for example.

(Combination Ratio Receiving Unit 110)

The combination ratio receiving unit 110 receives a combination ratio to be used by the combined vocal tract information generation unit 1052. The combination ratio receiving unit 110 transmits the received combination ratio to the combined vocal tract information generation unit 1052.

(Conversion Ratio Receiving Unit 111)

The conversion ratio receiving unit 111 receives a conversion ratio to be used by the synthesis unit 108. The conversion ratio receiving unit 111 transmits the received conversion ratio to the synthesis unit 108.

Next, the operations of the voice quality conversion system 100 having the above configuration will be described.

Figure 11A:
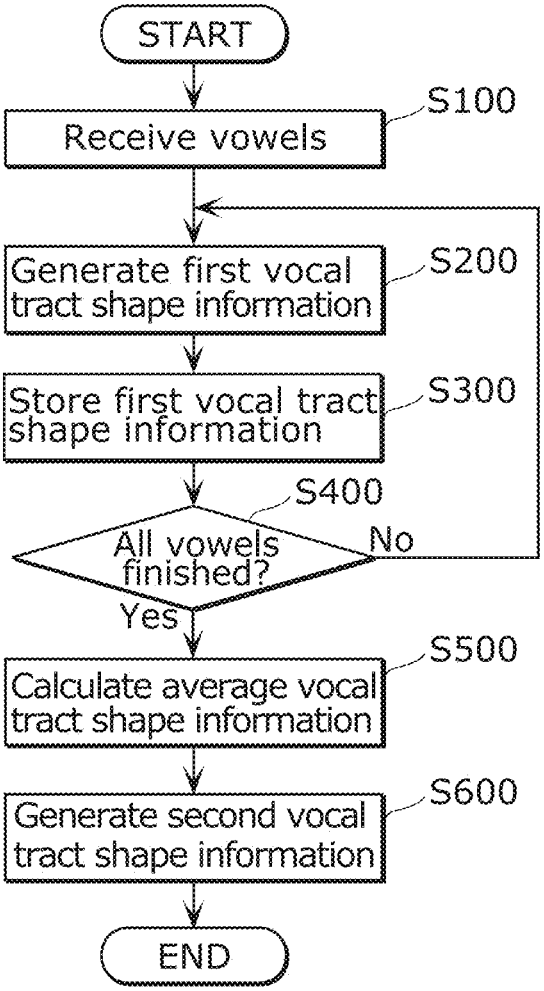
[FIG. 11A]
Figure 11B:
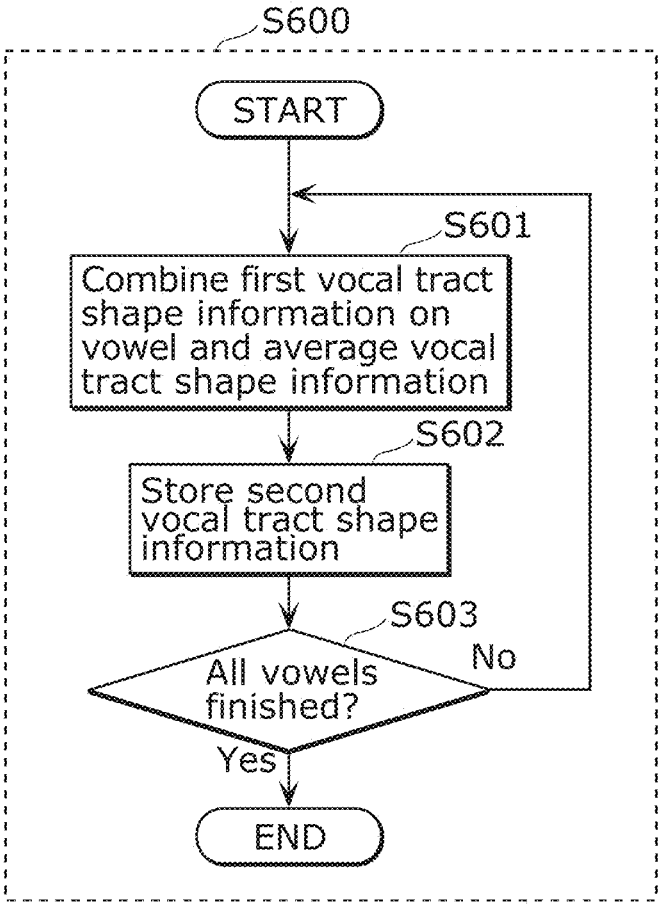
[FIG. 11B]
Figure 12:
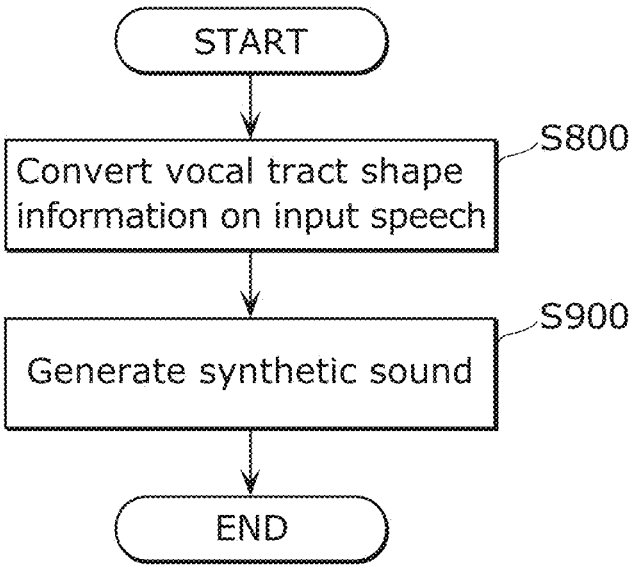
[FIG. 12]

FIG. 11A, FIG. 11B, and FIG. 12 are flowcharts showing the operations of the voice quality conversion system 100 according to Embodiment 1.

More specifically, FIG. 11A shows the flow of processing performed by the voice quality conversion system 100 from the reception of sounds of vowels to the generation of the second vocal tract shape information. FIG. 11B shows the details of the generation of the second vocal tract shape information (S600) shown in FIG. 11A. FIG. 12 shows the flow of processing for the conversion of the voice quality of the input speech according to Embodiment 1.

(Step S100)

The vowel receiving unit 102 receives speech including vowels uttered by the target speaker. The speech including vowels is, in the case of the Japanese language, for example, speech in which the Japanese five vowels "a—, i—, u—, e—, o—" (—means long vowels) are uttered. It is sufficient as long as the interval between each vowel is substantially 500 ms.

(Step S200)

The analysis unit 103 generates, as the first vocal tract shape information, the vocal tract shape information on one vowel included in the speech received by the vowel receiving unit 102.

(Step S300)

The analysis unit 103 stores the generated first vocal tract shape information in the first vowel vocal tract information storage unit 104.

(Step S400)

The analysis unit 103 determines whether or not the first vocal tract shape information has been generated for all types of vowels included in the speech received by the vowel receiving unit 102. For example, the analysis unit 103 obtains vowel type information on the vowels included in the speech received by the vowel receiving unit 102. Furthermore, the analysis unit 103 determines, by reference to the obtained vowel type information, whether or not the first vocal tract shape information on all types of vowels included in the speech are stored in the first vowel vocal tract information storage unit 104. When the first vocal tract shape information on all types of vowels are stored in the first vowel vocal tract information storage unit 104, the analysis unit 103 determines that the generation and storage of the first vocal tract shape information is completed. On the other hand, when the first vocal tract shape information on some type of vowels is not stored, the analysis unit 103 performs Step S200.

(Step S500)

The average vocal tract information calculation unit 1051 calculates a piece of average vocal tract shape information using the first vocal tract shape information on all types of vowels stored in the first vowel vocal tract information storage unit 104.

(Step S600)

The combined vocal tract information generation unit 1052 generates the second vocal tract shape information for each type of vowels included in the speech received in Step S100, using the first vocal tract shape information stored in the first vowel vocal tract information storage unit 104 and the average vocal tract shape information.

Here, the details of Step S600 will be described using FIG. 11B.

(Step S601)

The combined vocal tract information generation unit 1052 combines the first vocal tract shape information on one vowel stored in the first vowel vocal tract information storage unit 104 and the average vocal tract shape information to generate the second vocal tract shape information on that vowel.

(Step S602)

The combined vocal tract information generation unit 1052 stores the second vocal tract shape information generated in Step S601 in the second vowel vocal tract information storage unit 107.

(Step S603)

The combined vocal tract information generation unit 1052 determines whether or not Step S602 has been performed for all types of vowels included in the speech received in Step S100. For example, the combined vocal tract information generation unit 1052 obtains vowel type information on the vowels included in the speech received by the vowel receiving unit 102. The combined vocal tract information generation unit 1052 then determines, by reference to the obtained vowel type information, whether or not the second vocal tract shape information on all types of vowels included in the speech are stored in the second vowel vocal tract information storage unit 107.

When the second vocal tract shape information on all types of vowels are stored in the second vowel vocal tract information storage unit 107, the combined vocal tract information generation unit 1052 determines that the generation and storage of the second vocal tract shape information is completed. On the other hand, when the second vocal tract shape information on some type of vowels is not stored in the second vowel vocal tract information storage unit 107, the combined vocal tract information generation unit 1052 performs Step S601.

Next, using FIG. 12, the following describes the voice quality conversion performed on the input speech using the second vocal tract shape information generated in the above-described manner for each type of vowels.

(Step S800)

The synthesis unit 108 converts the vocal tract shape information on the input speech stored in the input speech storage unit 101, using the plural pieces of the second vocal tract shape information stored in the second vowel vocal tract information storage unit 107. More specifically, the synthesis unit 108 converts the vocal tract shape information on the input speech by combining the vocal tract shape information on the vowel(s) included in the input speech and the second vocal tract shape information on the same type of vowel as the vowel(s) included in the input speech.

(Step S900)

The synthesis unit 108 generates a synthetic sound using the vocal tract shape information on the input speech resulting from the conversion in Step S800 and the voicing source information on the input speech stored in the input speech storage unit 101. In this way, a synthetic sound is generated in which the voice quality of the input speech is converted. That is to say, the voice quality conversion system 100 can alter the features of the input speech.

(Experimental Results)

Figure 13A:
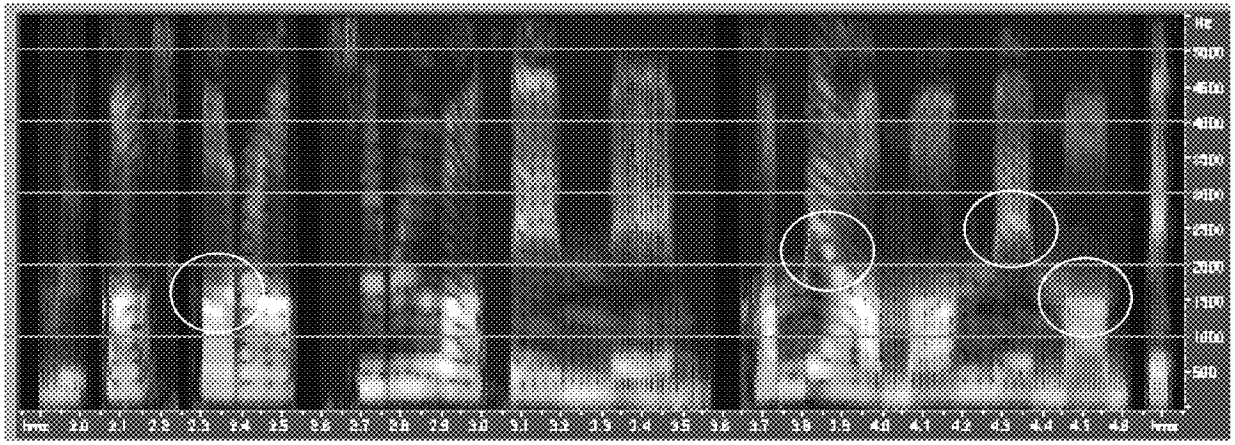
[FIG. 13A]
Figure 13A:
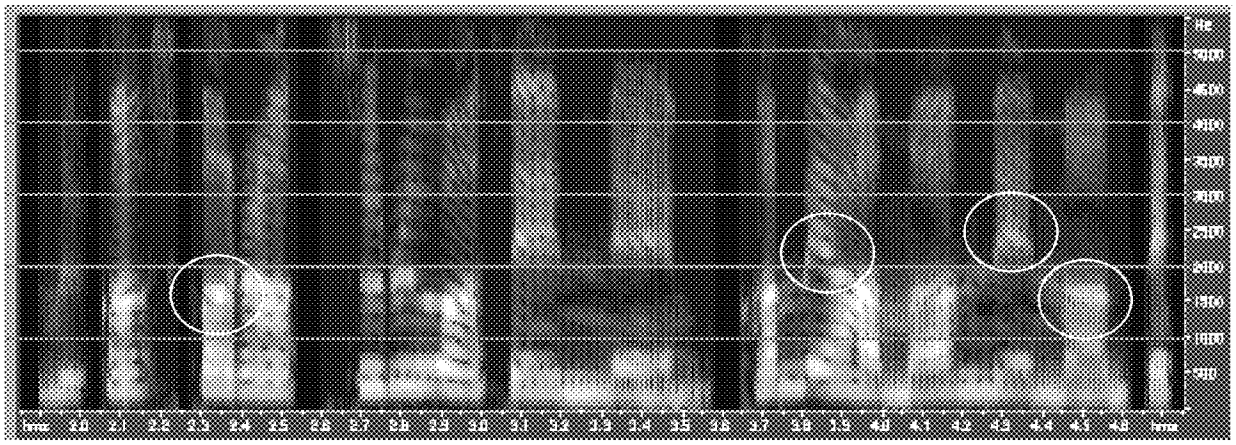

Next, the following describes the results of experiments in which the voice quality of input speech is actually converted. The experiments have confirmed the advantageous effect of the voice quality conversion. FIG. 13A shows the result of an experiment in which the voice quality of Japanese input speech is converted. In this experiment, the input speech was uttered as a sentence by a female speaker. The target speaker was another female speaker different from the one who uttered the input speech. FIG. 13A shows the result of converting the voice quality of the input speech based on vowels discretely uttered by the target speaker.

(a) of FIG. 13A shows a spectrogram obtained through the voice quality conversion according to a conventional technique. (b) of FIG. 13A shows a spectrogram obtained through the voice quality conversion by the voice quality conversion system 100 according to the present embodiment. This experiment used "0.3" as the obscuration degree coefficient a (combination ratio) in Equation (8). The content of the Japanese speech is "/ne e go i N kyo sa N, mu ka shi ka ra, tsu ru wa se N ne N, ka me wa ma N ne N na N to ko to o i i ma su ne/" ("Hi daddy. They say crane lives longer than a thousand years, and tortoise lives longer than ten thousand years, don't they?")

In (b) of FIG. 13A as compared to (a), the entire formant trajectory in the temporal direction is smooth, and the naturalness as the continuous utterance has improved. In particular, the portions surrounded by white circles in FIG. 13A show significant differences between (a) and (b).

Figure 13B:
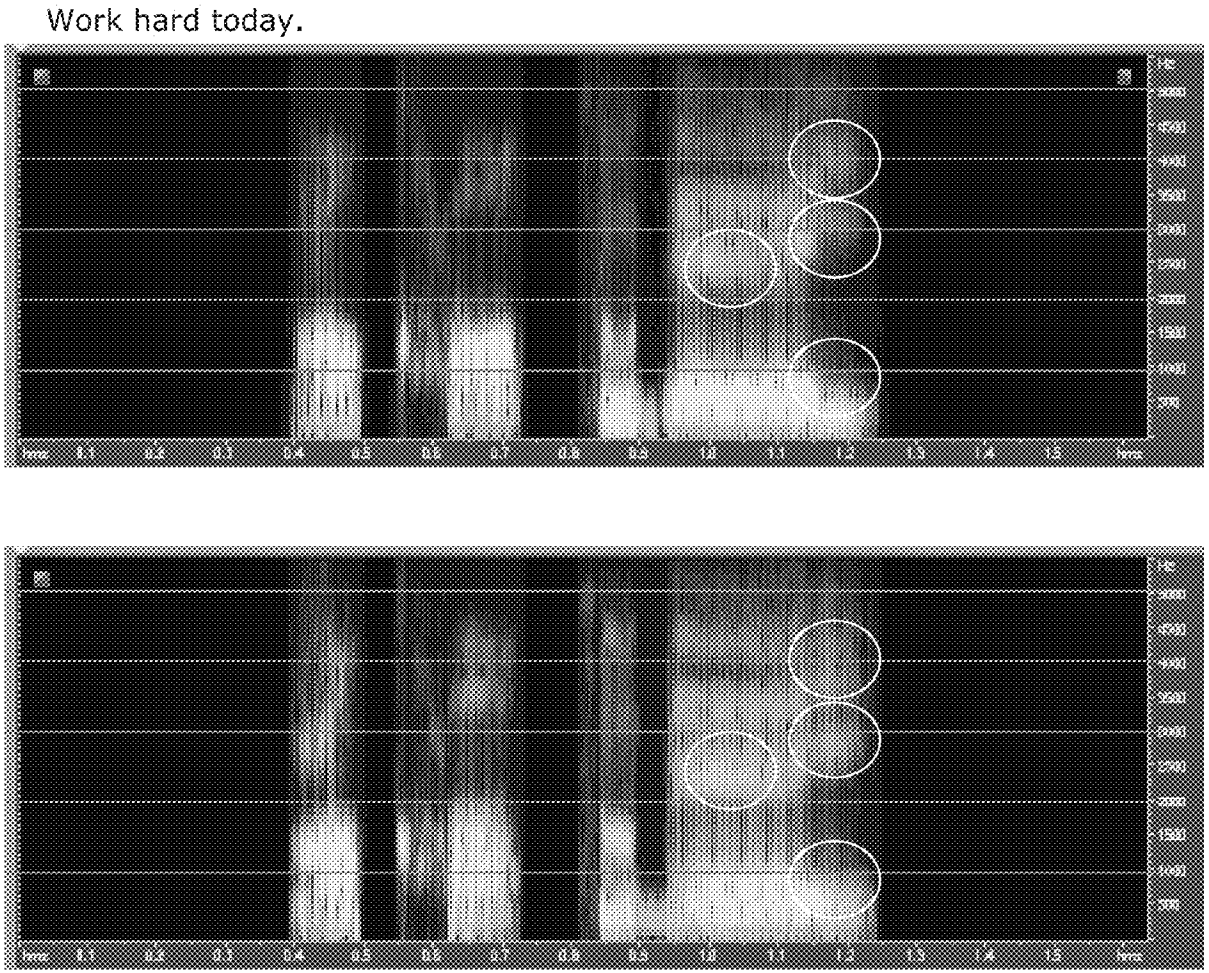
[FIG. 13B]

FIG. 13B shows the result of an experiment in which the voice quality of English input speech is converted. More specifically, (a) of FIG. 13B shows a spectrogram obtained through the voice quality conversion according to the conventional technique. (b) of FIG. 13B shows a spectrogram obtained through the voice quality conversion by the voice quality conversion system 100 according to the present embodiment.

The speaker of the input speech and the target speaker for FIG. 13B are the same as those for FIG. 13A. The obscuration degree coefficient a is also the same as that for FIG. 13A.

The content of the English speech is "Work hard today." The content of the English speech is replaced with a character string "ワークハードトゥデイ" in katakana, and a synthetic sound is generated using Japanese phonemes.

The rhythm (i.e., intonation pattern) of the speech after the voice quality conversion is the same as the rhythm of the input speech. Thus, even when the voice quality conversion is performed using Japanese phonemes, the speech resulting from the voice quality conversion remains to sound natural English to some degree. However, since there are more vowels in English than in Japanese, the Japanese representative vowels cannot fully express the English vowels.

In view of this, obscuring the vowels using the technique according to the present embodiment allows the resulting speech to sound less like Japanese and sound more natural as English speech. In particular, schwa, an obscure vowel shown below in the IPA, is, unlike the five Japanese vowels, located near the center of gravity of the pentagon formed by the five Japanese vowels on the F1-F2 plane. Thus, the obscuration according to the present embodiment produces a large advantageous effect.

[Math. 10]

[ə]

In particular, the portions surrounded by white circles in FIG. 13B show significant differences between (a) and (b). It can be seen that at the time of 1.2 seconds, there are differences not only in the first and second formant frequencies but also in the third formant frequency. The impression formed by actually hearing the synthetic sound was that the speech of (a) sounded like katakana spoken as it is, whereas the speech of (b) sounded acceptable as English. In addition, the speech of (a) sounded like the speaker was articulating with an effort when speaking English, whereas the speech of (b) sounded like the speaker was relaxed.

The reduction of articulation varies depending on the speech rate. When the speaker speaks slowly, each vowel is accurately articulated as in the case of discrete vowels. This feature is noticeable in singing, for example. When the input speech is a singing voice, the voice quality conversion system 100 can generate a natural synthetic sound even when the discrete vowels are used as they are for the voice quality conversion.

On the other hand, when the speaker speaks fast in a conversation manner, the reduction of articulation increases because movement of the articulator such as jaws and tongue cannot keep up with the speech rate. In view of this, the obscuration degree (combination ratio) may be set according to a local speech rate near a target phoneme. That is to say, the combination unit 105 may generate the second vocal tract shape information in such a manner that as the local speech rate for a vowel included in the input speech increases, the degree of approximation of the second vocal tract shape information on the same type of vowel as the vowel included in the input speech to the average vocal tract shape information increases. This allows the input speech to be converted into more smooth and natural speech.

More specifically, it is sufficient as long as the obscuration degree coefficient a (combination ratio) in Equation (8) is set as a function of the local speech rate r (the unit being the number of phonemes per second, for example) as in Equation (9) below, for example.

[Math. 11]

$$a=a_0+h(r-r_0) \tag{9}$$

Here, $a_0$ is a value representing a reference obscuration degree, and $r_0$ is a reference speech rate (the unit being the same as that of r). Furthermore, h is a predetermined value representing a sensitivity that changes a by r.

It is to be noted that the in-sentence vowels move further inside the polygon on the F1-F2 plane than the discrete vowels, but the degree of the movement depends on the vowel. For example, in FIG. 4A and FIG. 4B, although the movement of /o/ is relatively small, the inward movement of /a/ is large except for a small number of outliers. Furthermore, although most of /i/ have moved in a particular direction, /u/ have moved in various directions.

In view of this, changing the obscuration degree (combination ratio) depending on the vowel is also considered effective. More specifically, the combination unit 105 may combine, for each type of vowels, the first vocal tract shape information on that type of vowel and the first vocal tract shape information on a different type of vowel at the combination ratio set for that type of vowel. In this case, the obscuration degree may be set small for /o/ and large for /a/. Furthermore, the obscuration degree may be set large for /i/ and small for /u/ because in which direction /u/ should be moved is unknown. These tendencies may differ depending on the individuals, and thus the obscuration degrees may be changed depending on the target speaker.

The obscuration degree may be changed to suit a user's preference. In this case, it is sufficient as long as the user specifies a combination ratio indicating the obscuration degree of the user's preference for each type of vowels via the combination ratio receiving unit 110. That is to say, the combination unit 105 may combine, for each type of vowels, the first vocal tract shape information on that type of vowel and the first vocal tract shape information on a different type of vowel at the combination ratio set by the user.

Furthermore, although the average vocal tract information calculation unit 1051 calculates the average vocal tract shape information by calculating the arithmetic average of the plural pieces of the first vocal tract shape information as shown in Equation (7), the average vocal tract shape information need not be calculated using Equation (7). For example, the average vocal tract information calculation unit 1051 may assign ununiform values to the weighting factor $w_i$ in Equation (6) to calculate the average vocal tract shape information.

That is to say, the average vocal tract shape information may be the weighted arithmetic average of the first vocal tract shape information on plural vowels of different types. For example, it is effective to examine the features of reduction of articulation of each individual and adjust the weighting factor to resemble the individual's reduction of articulation. For example, assigning a weight to the first vocal tract shape information according to the feature of the reduction of articulation of the target speaker allows the input speech to be converted into more smooth and natural speech of the target speaker.

Moreover, instead of calculating the arithmetic average as shown in Equation (7), the average vocal tract information calculation unit 1051 may calculate a geometric average or a harmonic average as the average vocal tract shape information. More specifically, when the average vector of the PARCOR coefficients is expressed by Equation (10), the average vocal tract information calculation unit 1051 may calculate the geometric average of the first vocal tract shape information on plural vowels as the average vocal tract shape information as shown in Equation (11). Furthermore, the average vocal tract information calculation unit 1051 may calculate the harmonic average of the first vocal tract shape information on plural vowels as the average vocal tract shape information as shown in Equation (12).

[Math. 12]

$$\bar{k}=(\bar{k}_1\ \ \bar{k}_2\ \ \ldots\ \ \bar{k}_M) \tag{10}$$

[Math. 13]

$$\bar{k}_m=\sqrt[N]{\prod_{i=1}^{N}k_m^i}=\sqrt[N]{k_m^1k_m^2\ \ldots\ k_m^N} \tag{11}$$

[Math. 14]

$$\bar{k}_m=\frac{N}{\sum_{i=1}^{N}\frac{1}{k_m^i}}=\frac{N}{\frac{1}{k_m^1}+\frac{1}{k_m^2}+\cdots+\frac{1}{k_m^N}} \tag{12}$$

To put it briefly, it is sufficient as long as the average of the first vocal tract shape information on plural vowels is calculated in such a manner that when combined with the first vocal tract shape information on each vowel, there is reduction in the distribution of the vowels on the F1-F2 plane.

For example, in the case of the five Japanese vowels /a/, /i/, /u/, /e/, /o/, it is unnecessary to determine the average vocal tract shape information as shown in Equations (7), (11), and (12). For instance, an operation of bringing a vowel closer to the center of gravity of the pentagon by combining the vowel and one or more other vowels may be performed. In the case of obscuring the vowel /a/, for example, at least two vowels of different types from /a/ may be selected and combined with the vowel /a/ using a predetermined weight. When the pentagon formed on the F1-F2 plane by the five vowels is a convex pentagon (i.e., a pentagon having interior angles all of which are smaller than two right angles), a vowel obtained by combining /a/ and two other arbitrary vowels will always be located inside the pentagon. In most cases, the pentagon formed by the five Japanese vowels is a convex pentagon, and vowels can be obscured using this method.

Since English has more vowels than Japanese as mentioned above, the distances between the vowels on the F1-F2 plane tend to be smaller. This tendency differs depending on the language, and thus the obscuration degree coefficient may be set according to the language. That is to say, the combination unit 105 may combine, for each type of vowels, the first vocal tract shape information on that type of vowel and the first vocal tract shape information on a different type of vowel at the combination ratio set according to the language of the input speech. This makes it possible to set an obscuration degree which is appropriate for each language and to convert the input speech into more smooth and natural speech.

Figure 14:
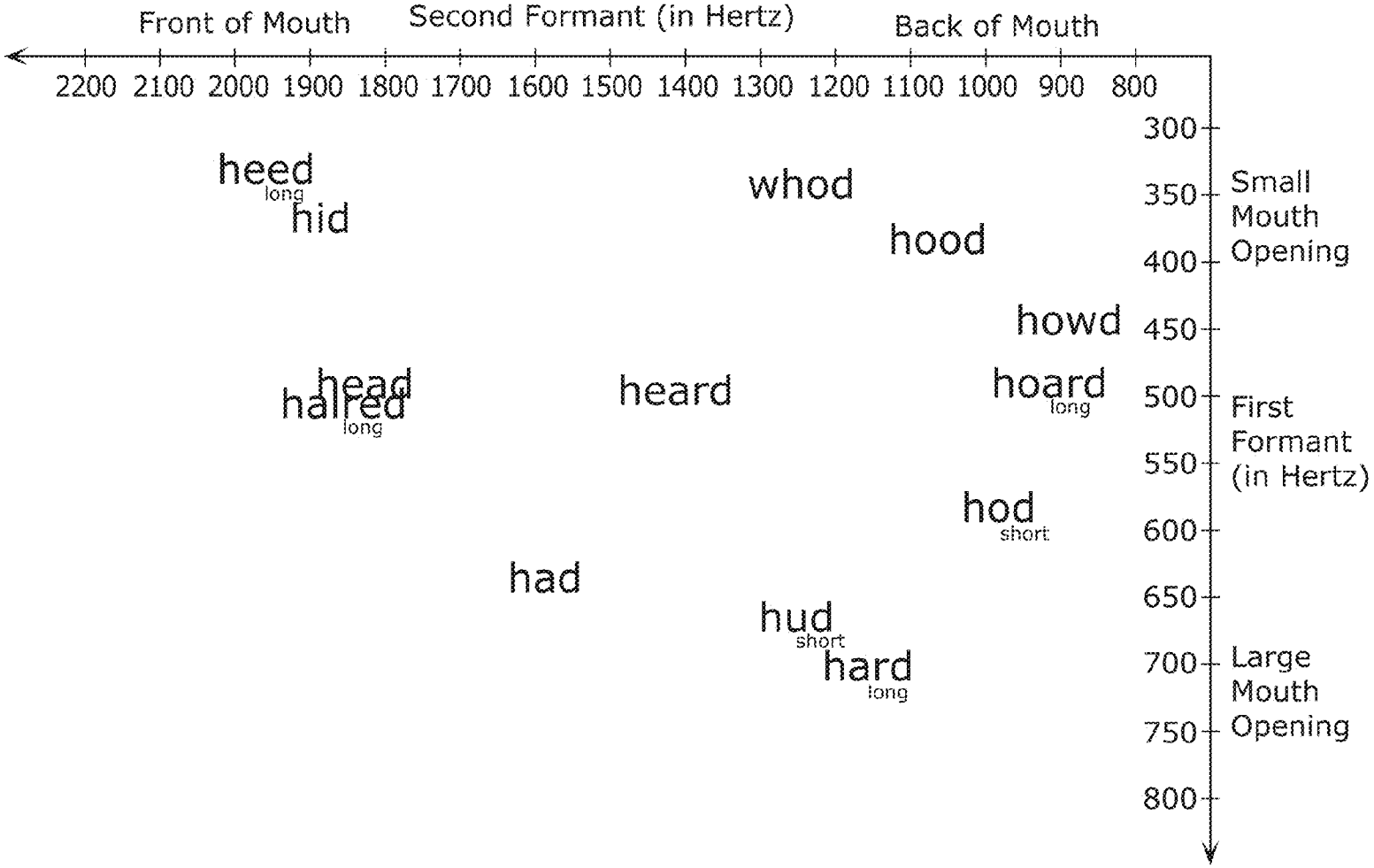
[FIG. 14]

Since English has more types of vowels than Japanese, the English polygon on the F1-F2 plane is more complicated than the Japanese polygon. FIG. 14 shows the 13 English vowels placed on the F1-F2 plane. It is to be noted that FIG. 14 has been cited from Ghonim, A., Smith, J. and Wolfe, J. (2007), "The sounds of world English", http://www.phys.unsw.edu.au/swe. In English, it is difficult to utter the vowels only. Thus, the vowels are shown using virtual words in which the vowels are interposed between [h] and [d]. Combining the average vocal tract shape information determined by averaging all the 13 vowels with each vowel obscures the vowels because the vowels move toward the center of gravity.

However, it is unnecessary to determine the average vocal tract shape information using all the vowels as described in relation to the Japanese case. With the way in which the vowels are placed in FIG. 14, a convex polygon can be formed using "heed", "haired", "had", "hard", "hod", "howd", and "whod". As in the case of the Japanese vowels, a vowel close to a side of this polygon can be obscured by selecting at least two vowels different from that vowel and combining that vowel with the selected vowels. On the other hand, vowels located inside the polygon ("heard" in the case of FIG. 14) are used as they are because they originally have an obscure sound.

As described above, the voice quality conversion system 100 according to the present embodiment only requires the input of a small number of vowels to generate smooth speech of the sentence utterance. In addition, remarkably flexible voice quality conversion is possible; for example, English speech can be generated using the Japanese vowels.

That is to say, the voice quality conversion system 100 according to the present embodiment can generate the second vocal tract shape information for each type of vowels by combining plural pieces of the first vocal tract shape information. This means that the second vocal tract shape information can be generated for each type of vowels using a small number of speech samples. The second vocal tract shape information generated in this manner for each type of vowels corresponds to the vocal tract shape information on that type of vowel which has been obscured. Thus, the voice quality conversion on the input speech using the second vocal tract shape information allows the input speech to be converted into smooth and natural speech.

Figure 15:
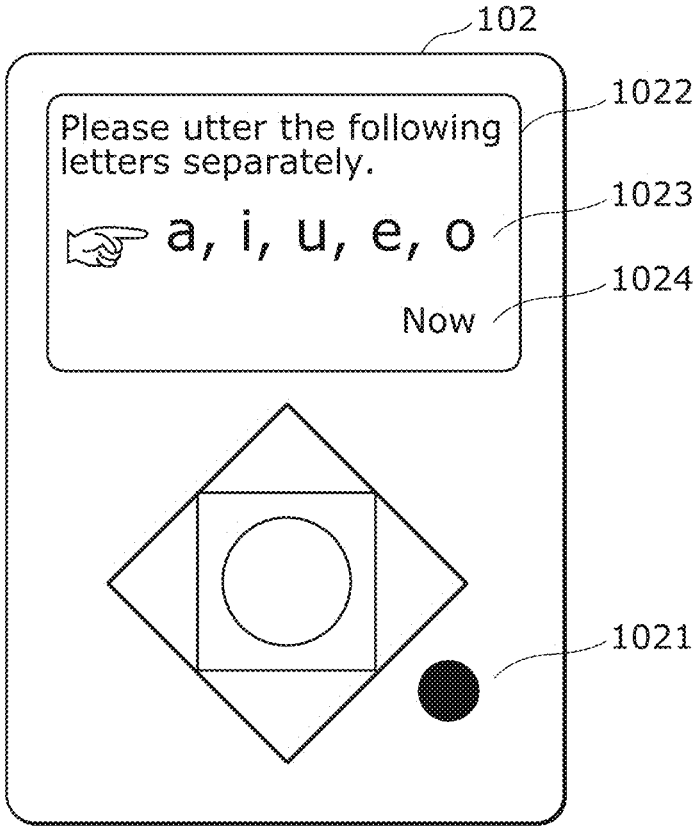
[FIG. 15]

It is to be noted that although the vowel receiving unit 102 typically includes a microphone as described earlier, it may further include a display device (prompter) for giving the user an instruction regarding what and when to utter. As a specific example, the vowel receiving unit 102 may include a microphone 1021 and a display unit 1022, such as a liquid crystal display, provided near the microphone 1021 as shown in FIG. 15. In this case, it is sufficient as long as the display unit 1022 displays what to be uttered by the target speaker 1023 (vowels in this case) and when to utter 1024.

It is to be noted that although the combination unit 105 according to the present embodiment calculates the average vocal tract shape information, the combination unit 105 need not calculate the average vocal tract shape information. For example, it is sufficient as long as the combination unit 105 combines, for each type of vowels, the first vocal tract shape information on that type of vowel and the first vocal tract shape information on a different type of vowel at a predetermined combination ratio, to generate the second vocal tract shape information on that type of vowel. Here, it is sufficient as long as the predetermined combination ratio is set to such a ratio at which the degree of approximation of the second vocal tract shape information to the average vocal tract shape information is greater than the degree of approximation of the second vocal tract shape information to the first vocal tract shape information.

That is to say, the combination unit 105 may combine plural pieces of the first vocal tract shape information in any manner as long as the second vocal tract shape information is generated so as to reduce the distances between the vowels on the F1-F2 plane. For example, the combination unit 105 may generate the second vocal tract shape information so as to prevent an abrupt change of the vocal tract shape information when vowels change from one to another in the input speech. More specifically, the combination unit 105 may combine the first vocal tract shape information on the same type of vowel as a vowel included in the input speech and the first vocal tract shape information on a different type of vowel from the vowel included in the input speech while varying the combination ratio according to the alignment of the vowels included in the input speech. As a result, the positions, on the F1-F2 plane, of vowels obtained from the second vocal tract shape information vary in the polygon even when the types of vowels are the same. This is possible by smoothing the time series of the PARCOR coefficients using the method of moving average, for example.

(Variation of Embodiment 1)

Next, a variation of Embodiment 1 will be described.

Although the vowel receiving unit 102 according to Embodiment 1 receives all the representative types of vowels of a target language (the five vowels in Japanese), the vowel receiving unit 102 according to the present variation need not receive all the types of vowels. In the present variation, the voice quality conversion is performed using fewer types of vowels than in Embodiment 1. Hereinafter, the method will be described.

The types of vowels are characterized by the first formant frequency and the second formant frequency; however, the values of the first and second formant frequencies differ depending on the individuals. Even so, as a model which explains the reason why a vowel uttered by different individuals is perceived as the same vowel, there is a model assuming that vowels are characterized by the ratio between the first formant frequency and the second formant frequency. Here, Equation (13) represents a vector $v_i$ consisting of the first formant frequency $f1_i$ and the second formant frequency $f2_i$ of the i-th vowel and Equation (14) represents a vector $v_i'$ obtained by moving the vector $v_i$ while maintaining the ratio between the first formant frequency and the second formant frequency.

[Math. 15]

$$v_i=[f1_i, f2_i] \tag{13}$$

[Math. 16]

$$v_i'=qv_i=q[f1_i, f2_i]=[qf1_i\ qf2_i] \tag{14}$$

q represents a ratio between the vector $v_i$ and the vector $v_i'$. According to the above-mentioned model, the vector $v_i$ and the vector $v_i'$ are perceived as the same vowel even when the ratio q is changed.

Figure 16:
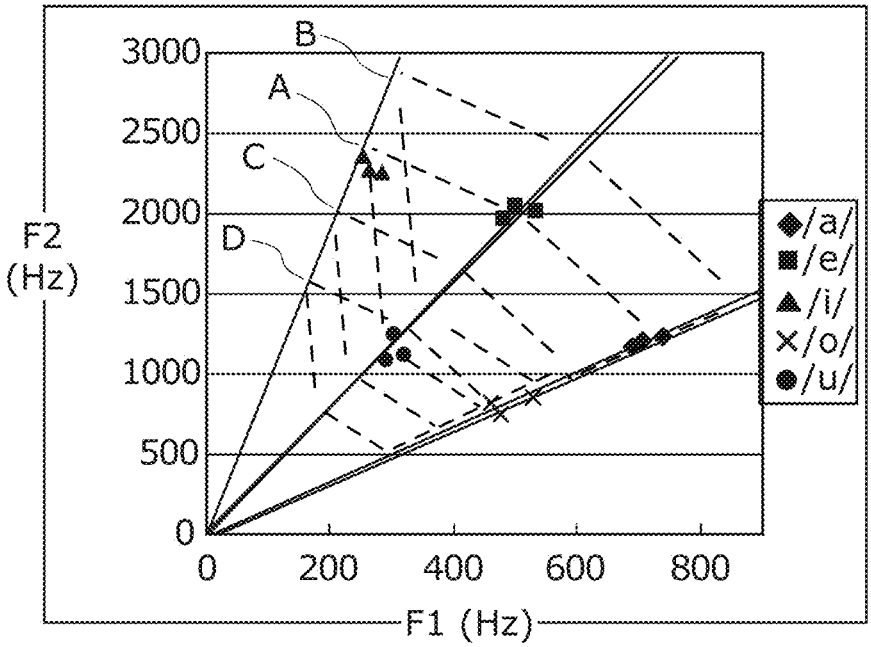
[FIG. 16]

When the first and second formant frequencies of all the discrete vowels are moved at the ratio q, polygons formed on the F1-F2 plane by the first and second formant frequencies of the respective vowels are similar to each other as shown in FIG. 16. FIG. 16 shows the original polygon A, a polygon B when q>1, and polygons C and D when q<1.

To change the vocal tract shape while maintaining the ratio between the first formant frequency $f1_i$ and the second formant frequency $f2_i$ in this manner, there is a method of changing the length of the vocal tract. Multiplying the length of the vocal tract by 1/q makes all the formant frequencies q-fold. In view of this, first, a vocal tract length conversion ratio r=1/q is calculated, and then, such conversion is performed that increases or decreases the vocal tract cross-sectional area function at the vocal tract length conversion ratio r.

First, the method of calculating the vocal tract length conversion ratio r will be described.

The PARCOR coefficient has a tendency to decrease in absolute value with increase in the order of the coefficient if the analysis order is sufficiently high. In particular, the value continues to be small for an order equal to or greater than the section number corresponding to the position of the vocal cords. In view of this, the values are sequentially examined from a high order coefficient to a low order coefficient to determine, as the position of the vocal cords, the position at which the absolute value exceeds a threshold, and the order k at that position is stored. Assuming ka as k obtained from a vowel prepared in advance, and kb as k obtained from an input vowel according to this method, the vocal tract length conversion ratio r can be calculated by Equation (15).

[Math. 17]

$$r=\frac{kb}{ka} \tag{15}$$

Next, the following describes the conversion method for increasing or decreasing the vocal tract cross-sectional area function at the vocal tract length conversion ratio r.

Figure 17:
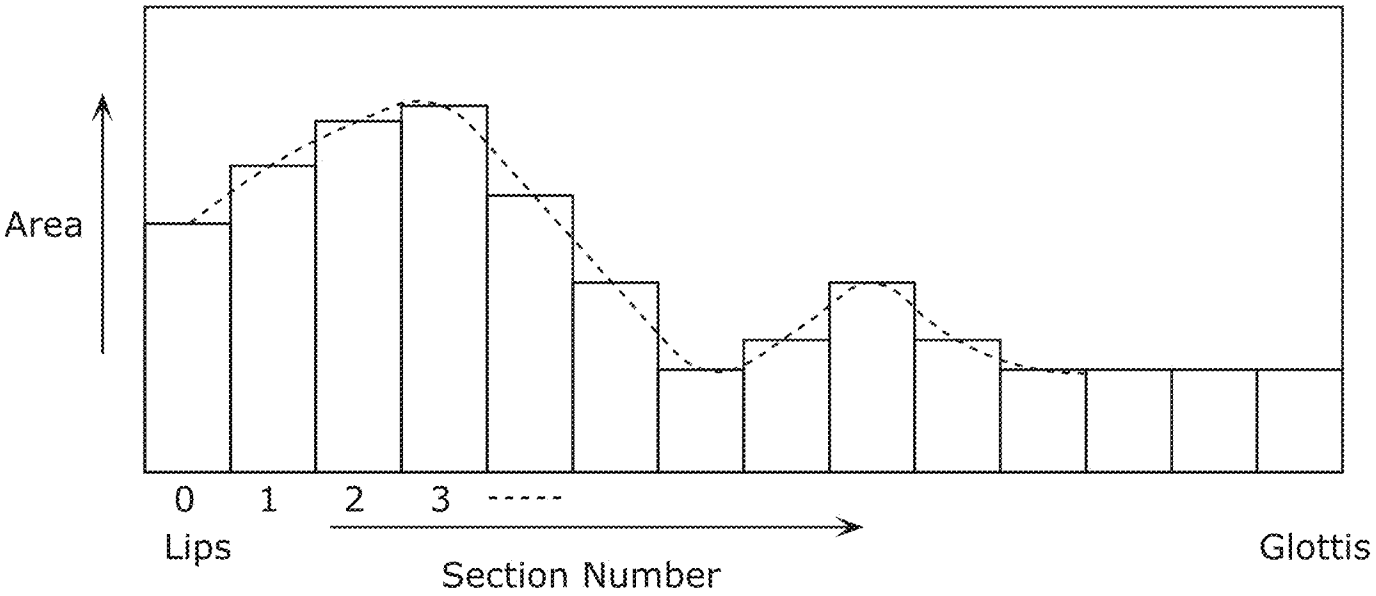
[FIG. 17]

FIG. 17 shows the vocal tract cross-sectional area function of a vowel. The horizontal axis shows, in section number, distance from the lips to the vocal cords. The vertical axis shows vocal tract cross-sectional area. The dashed line indicates a continuous function of the vocal tract cross-sectional area obtained through interpolation using a spline function or the like.

Figure 18:
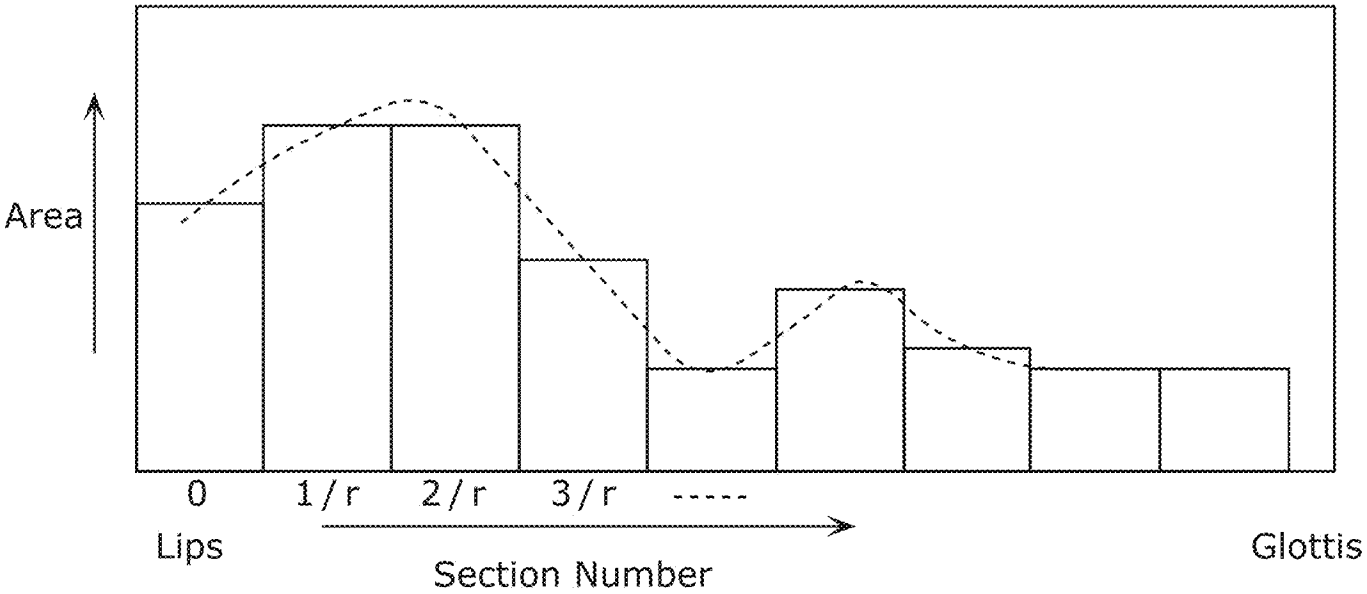
[FIG. 18]
Figure 19:
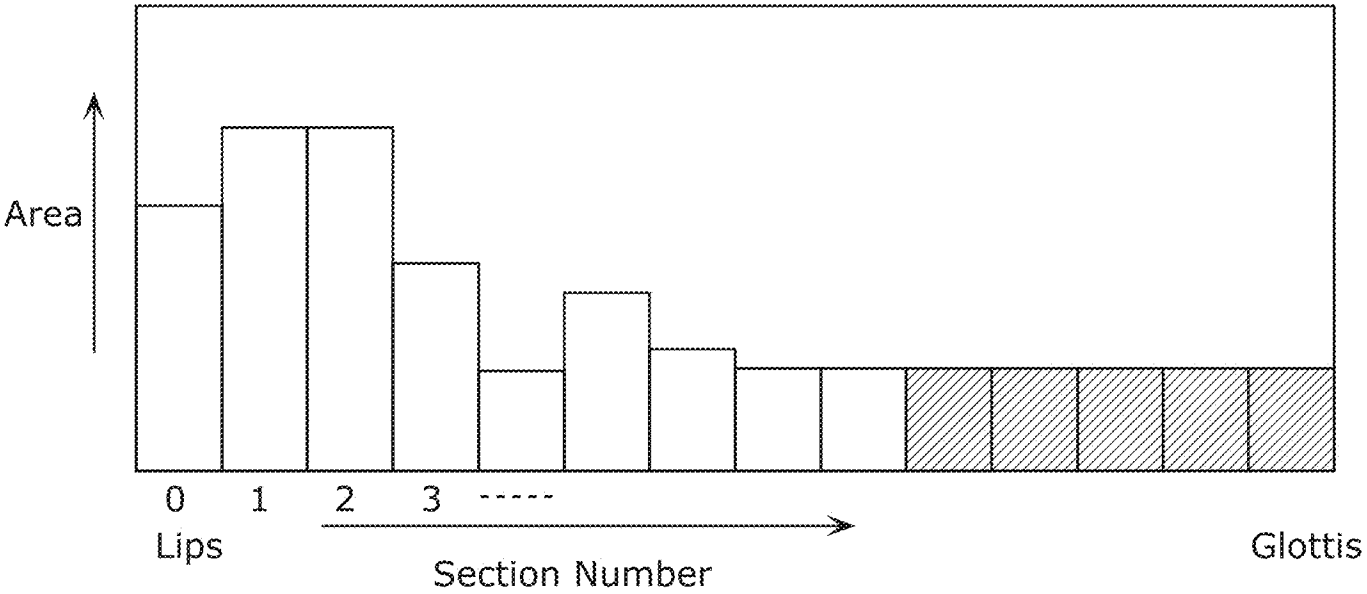
[FIG. 19]

The continuous function of the vocal tract cross-sectional area is sampled at new section intervals of 1/r (FIG. 18), and the sampled values are rearranged at the original section intervals (FIG. 19). This leaves remainder sections at the end of the vocal tract (on the vocal cords side) in the example of FIG. 19 (shaded portions in FIG. 19). The cross-sectional area for these remainder sections is set to a certain cross-sectional area. This is because the absolute value of the PARCOR coefficient becomes very small in sections exceeding the vocal tract length. More specifically, this is because the PARCOR coefficient with its sign reversed is a reflection coefficient between sections, and a reflection coefficient being zero means that there is no difference in cross-sectional area between sections.

The above example has shown the conversion method when the vocal tract length is to be decreased (r<1). When the vocal tract length is to be increased (r>1), there are sections exceeding the end of the vocal tract (on the vocal cords side). The values of these sections are discarded. To reduce the absolute values of the PARCOR coefficients being discarded, it is favorable to set the original analysis order high. For example, although the normal PARCOR analysis sets the order to be around 10 for speech having a sampling frequency of 10 kHz, it is favorable to set the order to a higher value such as 20.

Such a method as described above allows estimation of the vocal tract shape information on all the vowels from a single input vowel and a vowel prepared in advance. This reduces the need for the vowel receiving unit 102 to receive all the types of vowels.

(Embodiment 2)

Next, Embodiment 2 will be described.

The present embodiment is different from Embodiment 1 in that the voice quality conversion system includes two devices. Hereinafter, the description will be provided centering on the points different from Embodiment 1.

Figure 20:
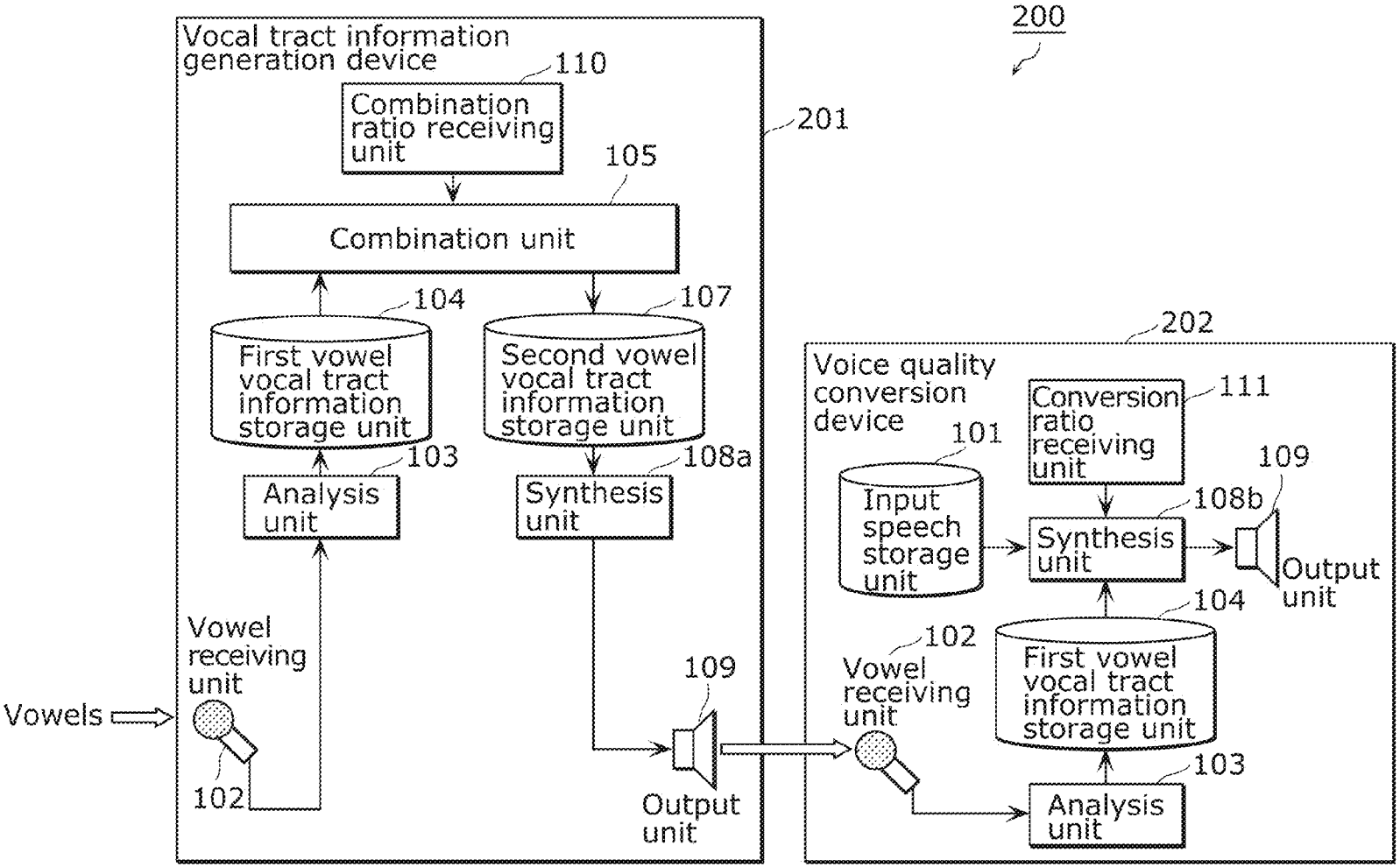
[FIG. 20]

FIG. 20 is a configuration diagram of a voice quality conversion system 200 according to Embodiment 2. In FIG. 20, the structural elements having the same functions as the structural elements in FIG. 8 are given the same reference signs and their descriptions are omitted.

As shown in FIG. 20, the voice quality conversion system 200 includes a vocal tract information generation device 201 and a voice quality conversion device 202.

The vocal tract information generation device 201 generates the second vocal tract shape information indicating the shape of the vocal tract, which is used for converting the voice quality of input speech. The vocal tract information generation device 201 includes the vowel receiving unit 102, the analysis unit 103, the first vowel vocal tract information storage unit 104, the combination unit 105, the combination ratio receiving unit 110, the second vowel vocal tract information storage unit 107, a synthesis unit 108*a*, and the output unit 109.

The synthesis unit 108*a* generates a synthetic sound for each type of vowels using the second vocal tract shape information stored in the second vowel vocal tract information storage unit 107. The synthesis unit 108*a* then transmits a signal of the generated synthetic sound to the output unit 109. The output unit 109 of the vocal tract information generation device 201 outputs the signal of the synthetic sound generated for each type of vowels, as speech.

Figure 21:
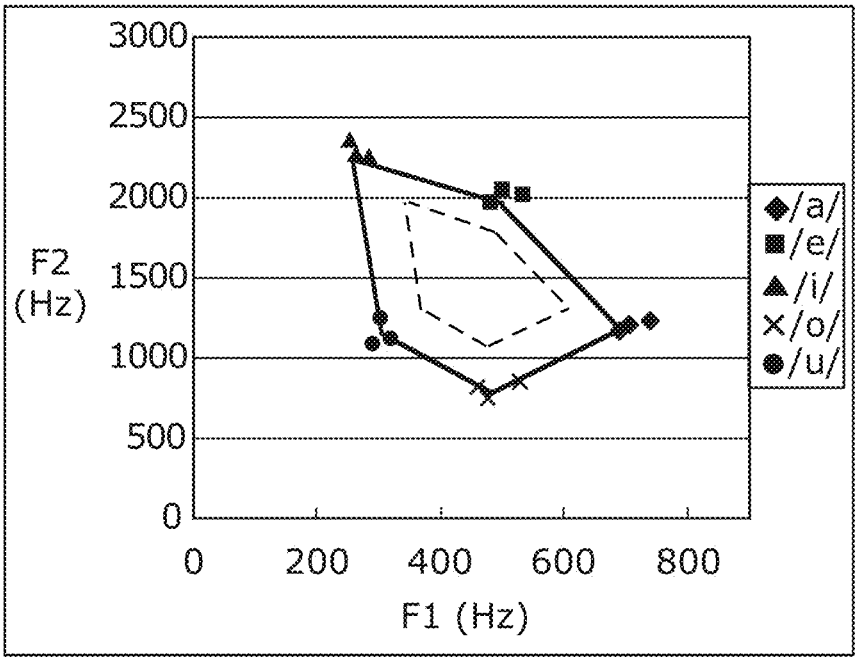
[FIG. 21]

FIG. 21 illustrates sounds of vowels outputted by the vocal tract information generation device 201 according to Embodiment 2. FIG. 21 shows, with solid lines, a pentagon formed on the F1-F2 plane by the sounds of plural vowels received by the vowel receiving unit 102 of the vocal tract information generation device 201. FIG. 21 also shows, with dashed lines, a pentagon formed on the F1-F2 plane by the sound outputted for each type of vowels by the output unit 109 of the vocal tract information generation device 201.

As is clear from FIG. 21, the output unit 109 of the vocal tract information generation device 201 outputs the sounds of obscured vowels.

The voice quality conversion device 202 converts the voice quality of input speech using the vocal tract shape information. The voice quality conversion device 202 includes the vowel receiving unit 102, the analysis unit 103, the first vowel vocal tract information storage unit 104, the input speech storage unit 101, a synthesis unit 108*b*, the conversion ratio receiving unit 111, and the output unit 109. The voice quality conversion device 202 has a configuration similar to that of the voice quality conversion device according to PTL 2 shown in FIG. 25.

The synthesis unit 108*b* converts the voice quality of the input speech using the first vocal tract shape information stored in the first vowel vocal tract information storage unit 104. According to the present embodiment, the vowel receiving unit 102 of the voice quality conversion device 202 receives the sounds of vowels obscured by the vocal tract information generation device 201. That is to say, the first vocal tract shape information stored in the first vowel vocal tract information storage unit 104 of the voice quality conversion device 202 corresponds to the second vocal tract shape information according to Embodiment 1. Thus, the output unit 109 of the voice quality conversion device 202 outputs the same speech as in Embodiment 1.

As described above, the voice quality conversion system 200 according to the present embodiment can be configured with the two devices, namely, the vocal tract information generation device 201 and the voice quality conversion device 202. Furthermore, it is possible for the voice quality conversion device 202 to have a configuration similar to that of the conventional voice quality conversion device. This means that the voice quality conversion system 200 according to the present embodiment can produce the same advantageous effect as in Embodiment 1 using the conventional voice quality conversion device.

(Embodiment 3)

Next, Embodiment 3 will be described.

The present embodiment is different from Embodiment 1 in that the voice quality conversion system includes two devices. Hereinafter, the description will be provided centering on the points different from Embodiment 1.

Figure 22:
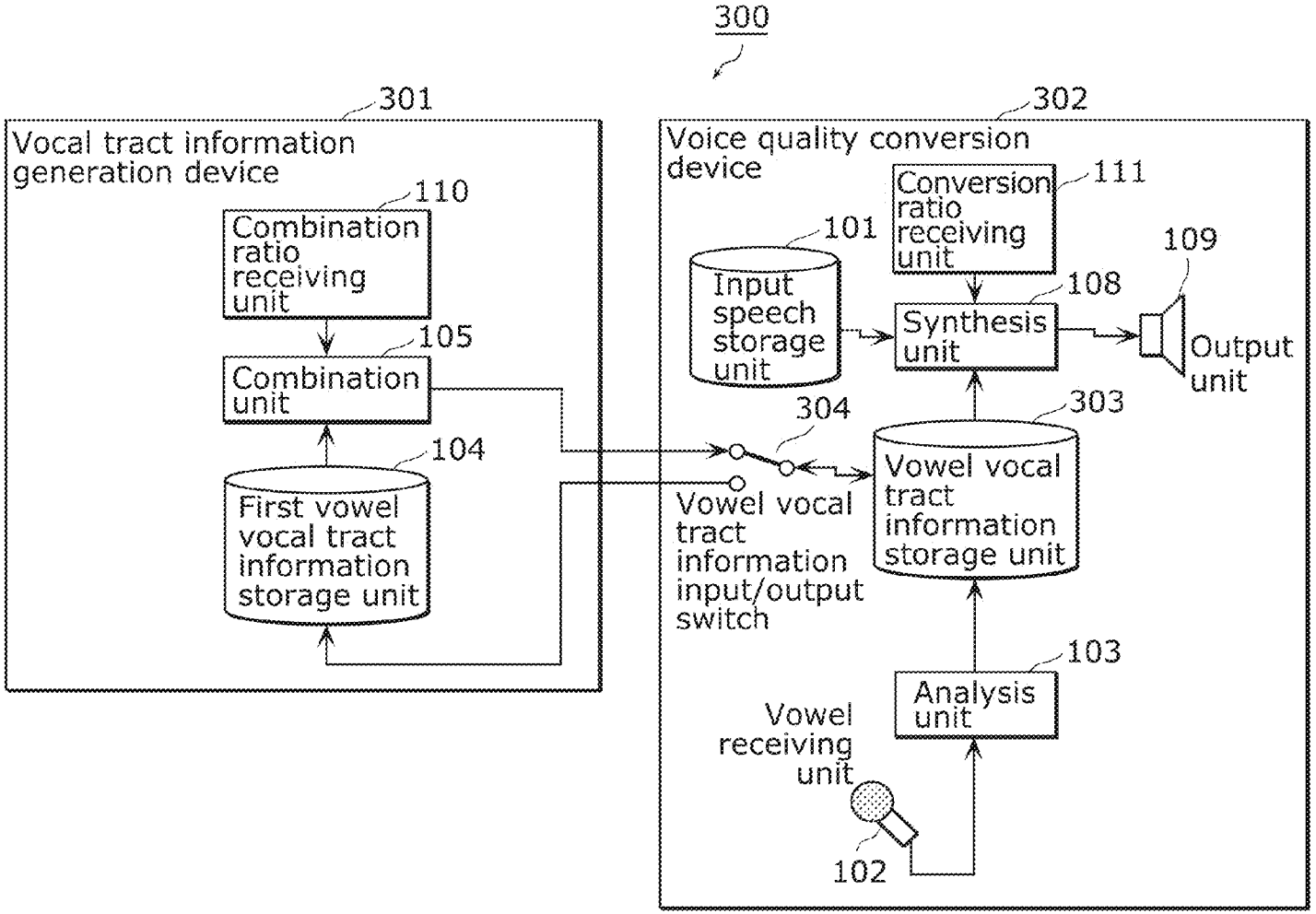
[FIG. 22]

FIG. 22 is a configuration diagram of a voice quality conversion system 300 according to Embodiment 3. In FIG. 22, the structural elements having the same functions as the structural elements in FIG. 8 are given the same reference signs and their descriptions are omitted.

As shown in FIG. 22, the voice quality conversion system 300 includes a vocal tract information generation device 301 and a voice quality conversion device 302.

The vocal tract information generation device 301 includes the first vowel vocal tract information storage unit 104, the combination unit 105, and the combination ratio receiving unit 110. The voice quality conversion device 302 includes the input speech storage unit 101, the vowel receiving unit 102, the analysis unit 103, the synthesis unit 108, the output unit 109, the conversion ratio receiving unit 111, a vowel vocal tract information storage unit 303, and a vowel vocal tract information input/output switch 304.

The vowel vocal tract information input/output switch 304 operates in a first mode or a second mode. More specifically, in the first mode, the vowel vocal tract information input/output switch 304 allows the first vocal tract shape information stored in the vowel vocal tract information storage unit 303 to be outputted to the first vowel vocal tract information storage unit 104. In the second mode, the vowel vocal tract information input/output switch 304 allows the second vocal tract shape information outputted from the combination unit 105 to be stored in the vowel vocal tract information storage unit 303.

The vowel vocal tract information storage unit 303 stores the first vocal tract shape information and the second vocal tract shape information. That is to say, the vowel vocal tract information storage unit 303 corresponds to the first vowel vocal tract information storage unit 104 and the second vowel vocal tract information storage unit 107 according to Embodiment 1.

The voice quality conversion system according to the present embodiment described above allows the vocal tract information generation device 301 having the function to obscure vowels to be configured as an independent device. The vocal tract information generation device 301 can be implemented as computer software since no microphone or the like is necessary. Thus, the vocal tract information generation device 301 can be provided as software (known as plug-in) added on to enhance the performance of the voice quality conversion device 302.

Moreover, the vocal tract information generation device 301 can be implemented also as a server application. In this case, it is sufficient as long as the vocal tract information generation device 301 is connected with the voice quality conversion device 302 via a network.

The herein disclosed subject matter is to be considered descriptive and illustrative only, and the appended Claims are of a scope intended to cover and encompass not only the particular embodiments disclosed, but also equivalent structures, methods, and/or uses.

For example, although the voice quality conversion systems according to Embodiments 1 to 3 above include plural structural elements, not all the structural elements need to be included. For example, the voice quality conversion system may have a configuration shown in FIG. 23.

Figure 23:
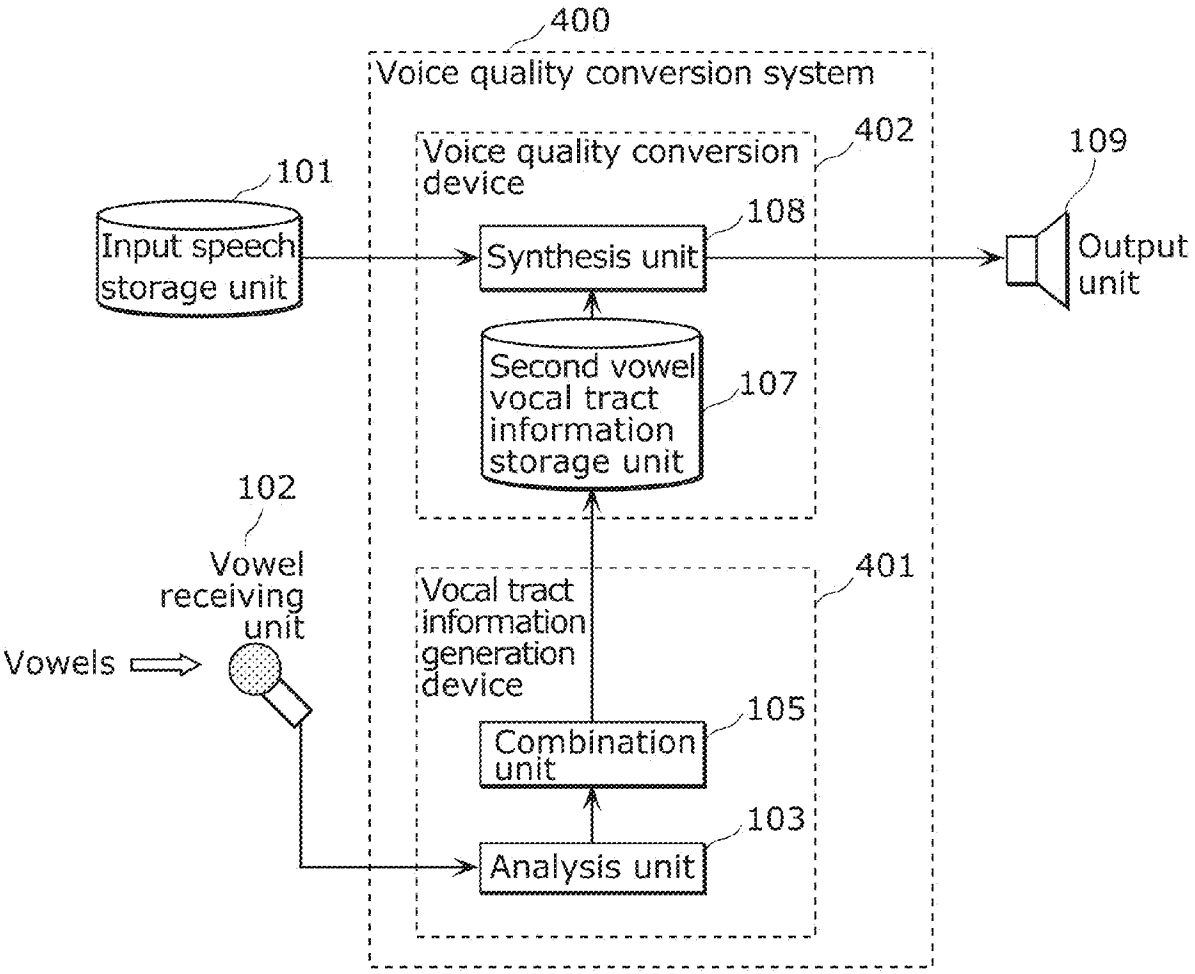
[FIG. 23]

FIG. 23 is a configuration diagram of a voice quality conversion system 400 according to another embodiment. It is to be noted that in FIG. 23, the structural elements common to FIG. 8 are given the same reference signs and their descriptions are omitted.

The voice quality conversion system 400 shown in FIG. 23 includes a vocal tract information generation device 401 and a voice quality conversion device 402.

The voice quality conversion system 400 shown in FIG. 23 includes (i) the vocal tract information generation device 401 which includes the analysis unit 103 and the combination unit 105, and (ii) the voice quality conversion device 402 which includes the second vowel vocal tract information storage unit 107 and the synthesis unit 108. It is to be noted that the voice quality conversion system 400 need not include the second vowel vocal tract information storage unit 107.

Even with such a configuration, the voice quality conversion system 400 can convert the voice quality of the input speech using the second vocal tract shape information that is the obscured vocal tract shape information. Thus, the voice quality conversion system 400 can produce the same advantageous effect as that of the voice quality conversion system 100 according to Embodiment 1.

Some or all of the structural elements included in the voice quality conversion system, the voice quality conversion device, or the vocal tract information generation device according to each embodiment above may be provided as a single system large scale integration (LSI) circuit.

The system LSI is a super multifunctional LSI manufactured by integrating plural structural elements on a single chip, and is specifically a computer system including a microprocessor, a read only memory (ROM), a random access memory (RAM), and so on. The ROM has a computer program stored therein. As the microprocessor operates according to the computer program, the system LSI performs its function.

Although the name used here is system LSI, it is also called IC, LSI, super LSI, or ultra LSI depending on the degree of integration. Furthermore, the means for circuit integration is not limited to the LSI, and a dedicated circuit or a general-purpose processor are also available. It is also acceptable to use: a field programmable gate array (FPGA) that is programmable after the LSI has been manufactured; and a reconfigurable processor in which connections and settings of circuit cells within the LSI are reconfigurable.

Furthermore, if a circuit integration technology that replaces LSI appears through progress in the semiconductor technology or other derivative technology, that circuit integration technology can be used for the integration of the functional blocks. Adaptation and so on in biotechnology is one such possibility.

Moreover, an aspect of the present disclosure may be not only a voice quality conversion system, a voice quality conversion device, or a vocal tract information generation device including the above-described characteristic structural elements, but also a voice quality conversion method or a vocal tract information generation method including, as steps, the characteristic processing units included in the voice quality conversion system, the voice quality conversion device, or the vocal tract information generation device. Furthermore, an aspect of the present disclosure may be a computer program which causes a computer to execute each characteristic step included in the voice quality conversion method or the vocal tract information generation method. Such a computer program may be distributed via a non-transitory computer-readable recording medium such as a CD-ROM or a communication network such as the Internet.

Each of the structural elements in each of the above-described embodiments may be configured in the form of an exclusive hardware product, or may be realized by executing a software program suitable for the structural element. Each of the structural elements may be realized by means of a program execution unit, such as a CPU and a processor, reading and executing the software program recorded on a recording medium such as a hard disk or a semiconductor memory. Here, the software programs for realizing the voice quality conversion system, the voice quality conversion device, and the vocal tract information generation device according to each of the embodiments are programs described below.

One of the programs causes a computer to execute a voice quality conversion method for converting a voice quality of input speech using vocal tract shape information indicating a shape of a vocal tract, the method including: receiving sounds of plural vowels of different types; analyzing the sounds of the plural vowels received in the receiving to generate first vocal tract shape information for each type of the vowels; combining, for each type of the vowels, the first vocal tract shape information on the type of vowel and the first vocal tract shape information on a different type of vowel to generate second vocal tract shape information on the type of vowel; combining vocal tract shape information on a vowel included in the input speech and the second vocal tract shape information on a same type of vowel as the vowel included in the input speech to convert vocal tract shape information on the input speech; and generating a synthetic sound using the vocal tract shape information on the input speech resulting from the conversion and voicing source information on the input speech to convert the voice quality of the input speech.

Another program causes a computer to execute a vocal tract information generation method for generating vocal tract shape information indicating a shape of a vocal tract and used for converting a voice quality of input speech, the method including: analyzing sounds of plural vowels of different types to generate first vocal tract shape information for each type of the vowels; and combining, for each type of the vowels, the first vocal tract shape information on the type of vowel and the first vocal tract shape information on a different type of vowel to generate second vocal tract shape information on the type of vowel.

Another program causes a computer to execute a voice quality conversion method for converting a voice quality of input speech using vocal tract shape information indicating a shape of a vocal tract, the method including: combining vocal tract shape information on a vowel included in the input speech and second vocal tract shape information on a same type of vowel as the vowel included in the input speech to convert vocal tract shape information on the input speech, the second vocal tract shape information being generated by combining first vocal tract shape information on the same type of vowel as the vowel included in the input speech and the first vocal tract shape information on a type of vowel different from the vowel included in the input speech; and generating a synthetic sound using the vocal tract shape information on the input speech resulting from the conversion and voicing source information on the input speech to convert the voice quality of the input speech.

Industrial Applicability

The voice quality conversion system according to one or more exemplary embodiments disclosed herein is useful as an audio editing tool, game, audio guidance for home appliances and so on, and audio output of robots, for example. The voice quality conversion system is also applicable to the purpose of making the output of text speech synthesis smoother and easier to listen, in addition to the purpose of converting a person's voice into another person's voice.

The invention claimed is:

1. A voice quality conversion system which converts a voice quality of input speech using vocal tract shape information indicating a shape of a vocal tract, the system comprising:

a hardware processor;

a vowel receiving unit configured to receive sounds of plural vowels of different types, each type of the vowels being a representative vowel of a spoken language;

an analysis unit configured to analyze, using the hardware processor, the sounds of the plural vowels received by the vowel receiving unit to generate first vocal tract shape information for each type of the vowels;

a combination unit configured to combine, for each type of the vowels, the first vocal tract shape information on the type of vowel and the first vocal tract shape information on a different type of vowel to generate second vocal tract shape information on the type of vowel; and a synthesis unit configured to (i) obtain vocal tract shape information and voicing source information on the input speech, (ii) combine vocal tract shape information on a vowel included in the input speech and the second vocal tract shape information on a same type of vowel as the vowel included in the input speech to convert the vocal tract shape information on the input speech, and (iii) generate a synthetic sound using the vocal tract shape information on the input speech resulting from the conversion and the voicing source information on the input speech to convert the voice quality of the input speech, wherein the combination unit includes:

an average vocal tract information calculation unit configured to calculate a piece of average vocal tract shape information by averaging plural pieces of the first vocal tract shape information generated for respective types of the vowels; and a combined vocal tract information generation unit configured to combine, for each type of the vowels received by the vowel receiving unit, the first vocal tract shape information on the type of vowel and the average vocal tract shape information to generate the second vocal tract shape information on the type of vowel.

2. The voice quality conversion system according to claim 1, wherein the average vocal tract information calculation unit is configured to calculate the average vocal tract shape information by calculating a weighted arithmetic average of the plural pieces of the first vocal tract shape information.

3. The voice quality conversion system according to claim 1, wherein the combination unit is configured to generate the second vocal tract shape information in such a manner that as a local speech rate for a vowel included in the input speech increases, a degree of approximation of the second vocal tract shape information on a same type of vowel as the vowel included in the input speech to an average of plural pieces of the first vocal tract shape information generated for respective types of the vowels increases.

4. The voice quality conversion system according to claim 1, wherein the combination unit is configured to combine, for each type of the vowels, the first vocal tract shape information on the type of vowel and the first vocal tract shape information on a different type of vowel at a combination ratio set for the type of vowel.

5. The voice quality conversion system according to claim 1, wherein the combination unit is configured to combine, for each type of the vowels, the first vocal tract shape information on the type of vowel and the first vocal tract shape information on a different type of vowel at a combination ratio set by a user.

6. The voice quality conversion system according to claim 1, wherein the combination unit is configured to combine, for each type of the vowels, the first vocal tract shape information on the type of vowel and the first vocal tract shape information on a different type of vowel at a combination ratio set according to a language of the input speech.

7. The voice quality conversion system according to claim 1, further comprising an input speech storage unit configured to store the vocal tract shape information and the voicing source information on the input speech, wherein the synthesis unit is configured to obtain the vocal tract shape information and the voicing source information on the input speech from the input speech storage unit.

8. A voice quality conversion method for converting a voice quality of input speech using vocal tract shape information indicating a shape of a vocal tract, the method comprising:

receiving sounds of plural vowels of different types, each type of the vowels being a representative vowel of a spoken language;

analyzing the sounds of the plural vowels received in the receiving to generate first vocal tract shape information for each type of the vowels;

combining, for each type of the vowels, the first vocal tract shape information on the type of vowel and the first vocal tract shape information on a different type of vowel to generate second vocal tract shape information on the type of vowel;

combining vocal tract shape information on a vowel included in the input speech and the second vocal tract shape information on a same type of vowel as the vowel included in the input speech to convert vocal tract shape information on the input speech; and generating a synthetic sound using the vocal tract shape information on the input speech resulting from the conversion and voicing source information on the input speech to convert the voice quality of the input speech, wherein the combining the first vocal tract shape information on the type of vowel and the first vocal tract shape information on a different type of vowel includes:

calculating a piece of average vocal tract shape information by averaging plural pieces of the first vocal tract shape information generated for respective types of the vowels; and combining, for each type of the vowels received in the receiving, the first vocal tract shape information on the type of vowel and the average vocal tract shape information to generate the second vocal tract shape information on the type of vowel.

9. A non-transitory computer-readable recording medium for use in a computer, the recording medium having a computer program recorded thereon for causing the computer to execute the voice quality conversion method according to claim 8.

10. A vocal tract information generation device which generates vocal tract shape information indicating a shape of a vocal tract and used for converting a voice quality of input speech, the device comprising:

a hardware processor;

an analysis unit configured to analyze, using the hardware processor, sounds of plural vowels of different types to generate first vocal tract shape information for each type of the vowels each type of the vowels being a representative vowel of a spoken language;

a combination unit configured to combine, for each type of the vowels, the first vocal tract shape information on the type of vowel and the first vocal tract shape information on a different type of vowel to generate second vocal tract shape information on the type of vowel;

a synthesis unit configured to generate a synthetic sound for each type of the vowels using the second vocal tract shape information; and an output unit configured to output the synthetic sound as speech, wherein the combination unit includes:

an average vocal tract information calculation unit configured to calculate a piece of average vocal tract shape information by averaging plural pieces of the first vocal tract shape information generated for respective types of the vowels; and a combined vocal tract information generation unit configured to combine, for each type of the vowels, the first vocal tract shape information on the type of vowel and the average vocal tract shape information to generate the second vocal tract shape information on the type of vowel.

11. A vocal tract information generation method for generating vocal tract shape information indicating a shape of a vocal tract and used for converting a voice quality of input speech, the method comprising:

analyzing sounds of plural vowels of different types to generate first vocal tract shape information for each type of the vowels, each type of the vowels being a representative vowel of a spoken language;

combining, for each type of the vowels, the first vocal tract shape information on the type of vowel and the first vocal tract shape information on a different type of vowel to generate second vocal tract shape information on the type of vowel;

generating a synthetic sound for each type of the vowels using the second vocal tract shape information; and outputting the synthetic sound as speech, wherein the combining the first vocal tract shape information on the type of vowel and the first vocal tract shape information on a different type of vowel includes:

calculating a piece of average vocal tract shape information by averaging plural pieces of the first vocal tract shape information generated for respective types of the vowels; and combining, for each type of the vowels, the first vocal tract shape information on the type of vowel and the average vocal tract shape information to generate the second vocal tract shape information on the type of vowel.

12. A non-transitory computer-readable recording medium for use in a computer, the recording medium having a computer program recorded thereon for causing the computer to execute the vocal tract information generation method according to claim 11.

13. A voice quality conversion device which converts a voice quality of input speech using vocal tract shape information indicating a shape of a vocal tract, the device comprising:

a hardware processor;

a vowel vocal tract information storage unit configured to store second vocal tract shape information generated by combining, for each type of vowels, first vocal tract shape information on the type of vowel and an average vocal tract shape information calculated by averaging plural pieces of the first vocal tract shape information generated for respective types of the vowels, each type of the vowels being a representative vowel of a spoken language; and a synthesis unit configured to, using the hardware processor, (i) combine vocal tract shape information on a vowel included in the input speech and the second vocal tract shape information on a same type of vowel as the vowel included in the input speech to convert vocal tract shape information on the input speech, and (ii) generate a synthetic sound using the vocal tract shape information on the input speech resulting from the conversion and voicing source information on the input speech to convert the voice quality of the input speech.

14. A voice quality conversion method for converting a voice quality of input speech using vocal tract shape information indicating a shape of a vocal tract, the method comprising:

combining vocal tract shape information on a vowel included in the input speech and second vocal tract shape information on a same type of vowel as the vowel included in the input speech to convert vocal tract shape information on the input speech, the second vocal tract shape information being generated by combining first vocal tract shape information on the same type of vowel as the vowel included in the input speech and an average vocal tract shape information calculated by averaging plural pieces of first vocal tract shape information generated for respective types of vowels, each type of the vowels being a representative vowel of a spoken language; and generating a synthetic sound using the vocal tract shape information on the input speech resulting from the conversion and voicing source information on the input speech to convert the voice quality of the input speech.

15. A non-transitory computer-readable recording medium for use in a computer, the recording medium having a computer program recorded thereon for causing the computer to execute the voice quality conversion method according to claim 14.

* * * * *